US012768543B2

(12) United States Patent
Kweon et al.

(10) Patent No.: US 12,768,543 B2
(45) Date of Patent: Oct. 20, 2026

(54) COOKING APPARATUS

(71) Applicant: SAMSUNG ELECTRONICS CO., LTD., Suwon-si (KR)

(72) Inventors: Sooncheol Kweon, Suwon-si (KR); Sanghyun Yeo, Suwon-si (KR); Sunghoo Lee, Suwon-si (KR); Bokhyun Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 377 days.

(21) Appl. No.: 18/524,897

(22) Filed: Nov. 30, 2023

(65) Prior Publication Data

US 2024/0093877 A1 Mar. 21, 2024

Related U.S. Application Data

(63) Continuation of application No. PCT/KR2023/012418, filed on Aug. 22, 2023.

(30) Foreign Application Priority Data

Sep. 7, 2022 (KR) ..... 10-2022-0113825
Feb. 3, 2023 (KR) ..... 10-2023-0015111

(51) Int. Cl.
*F24C 15/00* (2006.01)

(52) U.S. Cl.
CPC ..... *F24C 15/006* (2013.01)

(58) Field of Classification Search
CPC ... H05K 7/20145; B03B 17/55; F24C 15/006; F24C 15/322; F24C 7/085; F21V 29/677
USPC ..... 126/19 R
See application file for complete search history.

(56) References Cited

U.S. PATENT DOCUMENTS

| | | | |
|---|---|---|---|
| 10,148,451 | B2 | 12/2018 | Luckhardt et al. |
| 10,760,794 | B2 | 9/2020 | Cheng |
| 10,794,599 | B2 | 10/2020 | Jang et al. |
| 11,274,833 | B2 | 3/2022 | Jang et al. |
| 11,353,219 | B2 | 6/2022 | Iwamoto et al. |

(Continued)

FOREIGN PATENT DOCUMENTS

| | | |
|---|---|---|
| JP | 2008-292009 | 12/2008 |
| JP | 2018-534514 | 11/2018 |

(Continued)

OTHER PUBLICATIONS

International Search Report, PCT/ISA/210, dated Dec. 13, 2023, in PCT Application No. PCT/KR2023/012418.

(Continued)

*Primary Examiner* — Vivek K Shirsat
(74) *Attorney, Agent, or Firm* — STAAS & HALSEY LLP

(57) ABSTRACT

A cooking apparatus including a main body including an inner case, a cooking chamber inside the inner case, and an electronic compartment outside the inner case. The cooking apparatus further includes an electronic compartment cooling fan configured to cool the electronic compartment, an electronic compartment duct dividing the electronic compartment into an electronic component space and an exhaust space, a camera cooling duct including a camera receiving space; a camera in the camera receiving space and configured to obtain an image of an inside of the cooking chamber, and a camera cooling fan configured to cool the camera.

17 Claims, 22 Drawing Sheets

(56) References Cited

U.S. PATENT DOCUMENTS

| | | | | |
|---|---|---|---|---|
| 2012/0076351 | A1 | 3/2012 | Yoon et al. | |
| 2018/0058702 | A1* | 3/2018 | Jang | F24C 15/322 |
| 2021/0018182 | A1 | 1/2021 | Jang et al. | |

FOREIGN PATENT DOCUMENTS

| | | |
|---|---|---|
| KR | 10-2010-0134422 | 12/2010 |
| KR | 10-2010-0134430 | 12/2010 |
| KR | 10-2018-0025787 | 3/2018 |
| KR | 10-2018-0137999 | 12/2018 |
| KR | 10-2021-0003664 | 1/2021 |
| KR | 10-2021-0083041 | 7/2021 |
| KR | 10-2022-0098482 | 7/2022 |
| WO | WO 2016/034295 A1 | 3/2016 |

OTHER PUBLICATIONS

Written Opinion, PCT/ISA/237, dated Dec. 13, 2023, in PCT Application No. PCT/KR2023/012418.

* cited by examiner

COOKING APPARATUS

CROSS-REFERENCE TO RELATED APPLICATION(S)

This application is a by-pass continuation application, under 35 U.S.C. § 111(a), of International Application No. PCT/KR2023/012418, filed on Aug. 22, 2023, which claims priority to Korean Patent Applications No. 10-2022-0113825, filed on Sep. 7, 2022, and No. 10-2023-0015111, filed on Feb. 3, 2023, in the Korean Intellectual Property Office, the disclosures of which are incorporated by reference herein in their entireties

BACKGROUND

Technical Field

The disclosure relates to a cooking apparatus including a camera configured to image an inside of a cooking chamber.

Background Art

In general, a cooking apparatus includes a cooking chamber and a heating device configured to heat the cooking chamber to cook food. The cooking apparatus may include an oven using an electric heater or gas as a heating device and a microwave oven using a magnetron configured to generate microwaves as a heating device.

The cooking apparatus may be equipped with a camera to image an inside of the cooking chamber. The type, state, etc. of food may be recognized using the installed camera, and the cooking apparatus may be controlled accordingly.

The inside of the cooking chamber may be heated to a high temperature and the camera may be vulnerable to heat. Accordingly, a structure for properly cooling the camera is required to prevent the camera from being damaged or malfunctioning due to high temperature heat.

SUMMARY

Technical Problem

It is an aspect of various embodiments of the disclosure to provide a cooking apparatus including a structure in which a camera is disposed above a cooking chamber to clearly image an inside of the cooking chamber, the structure capable of cooling the camera to prevent a temperature rise of the camera caused by heat generated in the cooking chamber.

It is another aspect of various embodiments of the disclosure to provide a cooking apparatus capable of preventing foreign substances such as water and oil from entering through a suction duct used to cool a camera.

It is another aspect of various embodiments of the disclosure to provide a cooking apparatus including a cooling structure capable of efficiently cooling a lower portion of a camera close to a cooking chamber.

It is another aspect of various embodiments of the disclosure to provide a cooking apparatus including an electronic compartment cooling structure for cooling an entire electronic compartment formed outside a cooking chamber, and a camera cooling structure for intensively cooling a camera.

It is another aspect of various embodiments of the disclosure to provide a cooking apparatus capable of efficiently cooling an electronic component such as a circuit board disposed in an electronic compartment.

It is another aspect of various embodiments of the disclosure to provide a cooking apparatus capable of preventing a flow of air for cooling a camera from interfering with a flow of air for cooling an entire electronic compartment.

It is another aspect of various embodiments of the disclosure to provide a cooking apparatus capable of increasing a viewing angle of a camera by installing the camera to be maximally close to a transparent member of a cooking camber. The technical challenges of the present document are not limited to those mentioned above, and other technical challenges not mentioned will be apparent to one having ordinary skill in the art from the following description.

Technical Solution

According to an embodiment of the disclosure, a cooking apparatus may include a main body including an inner case, a cooking chamber inside the inner case, and an electronic compartment outside the inner case; a heating device configured to heat the cooking chamber; an electronic compartment cooling fan configured to cool the electronic compartment; an electronic compartment duct arranged in the electronic compartment and dividing the electronic compartment into an electronic component space and an exhaust space, the electronic compartment duct configured to allow air in the electronic component space to be sucked into the exhaust space and to then be discharged to an outside of the main body according to an operation of the electronic compartment cooling fan; a camera cooling duct including a camera receiving space; a camera in the camera receiving space and configured to obtain an image of an inside of the cooking chamber; and a camera cooling fan configured to cool the camera, wherein the camera cooling duct is configured to allow air outside the main body to be sucked into the camera receiving space so as to cool the camera and to then be discharged to the electronic component space according to an operation of the camera cooling fan.

According to an embodiment of the disclosure, a cooking apparatus may include a main body including a rear plate forming a rear surface of the main body, the main body having a cooking chamber inside the main body; a heating device configured to heat the cooking chamber; a housing, inside the main body, having a camera receiving space; a camera in the camera receiving space, and configured to obtain an image of an inside of the cooking chamber; a camera cooling fan configured to cool the camera; and a suction duct having one end coupled to the housing and an other end coupled to the rear plate, and being configured to allow air outside the main body to be sucked into the camera receiving space so as to cool the camera according to an operation of the camera cooling fan.

According to an embodiment of the disclosure, a cooking apparatus may include a main body having a cooking chamber and an electronic compartment inside the main body; a heating device configured to heat the cooking chamber; an electronic compartment cooling fan configured to cool the electronic compartment; an electronic compartment duct in the electronic compartment and dividing the electronic compartment into an electronic component space and an exhaust space, the electronic compartment duct configured to allow air in the electronic component space to be sucked into the exhaust space and to then be discharged to an outside of the main body according to an operation of the electronic compartment cooling fan; a housing having a camera receiving space, and an outlet through which air in the camera receiving space is dischargeable to the electronic component space; a camera in the camera receiving space and configured to obtain an image of an inside of the cooking chamber; a camera cooling fan configured to cool the camera; and a suction duct configured to allow air outside the main body to be sucked into the camera receiving space so as to cool the camera according to an operation of the camera cooling fan.

DETAILED DESCRIPTION

Figure 1:
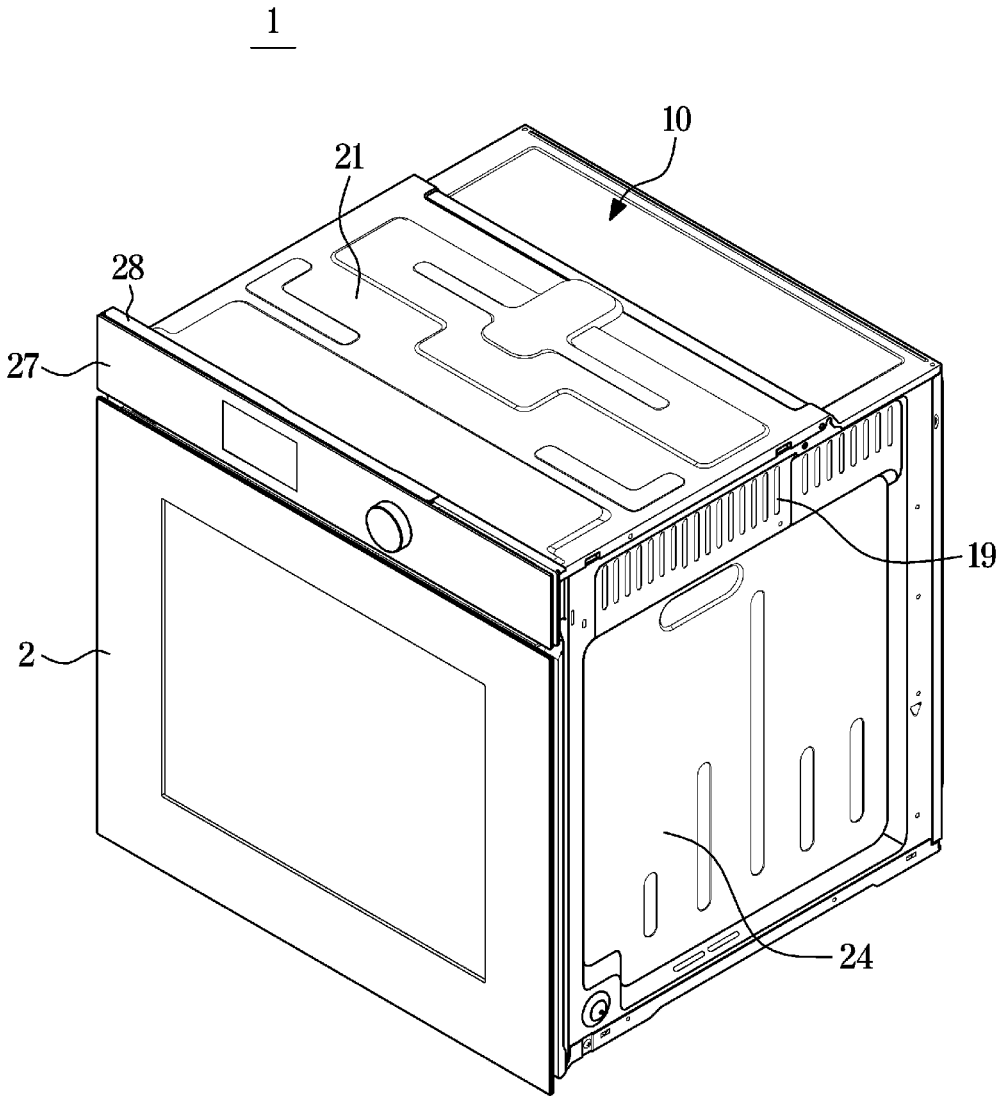
FIG. 1 is a view illustrating an appearance of a cooking apparatus according to an embodiment of the disclosure.

The various embodiments and the terms used therein are not intended to limit the technology disclosed herein to specific forms, and the disclosure should be understood to include various modifications, equivalents, and/or alternatives to the corresponding embodiments.

In describing the drawings, similar reference numerals may be used to designate similar constituent elements.

A singular expression may include a plural expression unless they are definitely different in a context.

The expressions "A or B," "at least one of A or/and B," or "one or more of A or/and B," A, B or C," "at least one of A, B or/and C," or "one or more of A, B or/and C," and the like used herein may include any and all combinations of one or more of the associated listed items.

The term of "and/or" includes a plurality of combinations of relevant items or any one item among a plurality of relevant items.

Herein, the expressions "a first", "a second", "the first", "the second", etc., may simply be used to distinguish an element from other elements, but is not limited to another aspect (importance or order) of elements.

When an element (e.g., a first element) is referred to as being "(functionally or communicatively) coupled," or "connected" to another element (e.g., a second element), the first element may be connected to the second element, directly (e.g., wired), wirelessly, or through a third element.

In this disclosure, the terms "including", "having", and the like are used to specify features, numbers, steps, operations, elements, elements, or combinations thereof, but do not preclude the presence or addition of one or more of the features, elements, steps, operations, elements, elements, or combinations thereof.

When an element is said to be "connected", "coupled", "supported" or "contacted" with another element, this includes not only when elements are directly connected, coupled, supported or contacted, but also when elements are indirectly connected, coupled, supported or contacted through a third element.

Throughout the description, when an element is "on" another element, this includes not only when the element is in contact with the other element, but also when there is another element between the two elements.

Reference will now be made in detail to embodiments of the disclosure, examples of which are illustrated in the accompanying drawings.

Figure 2:
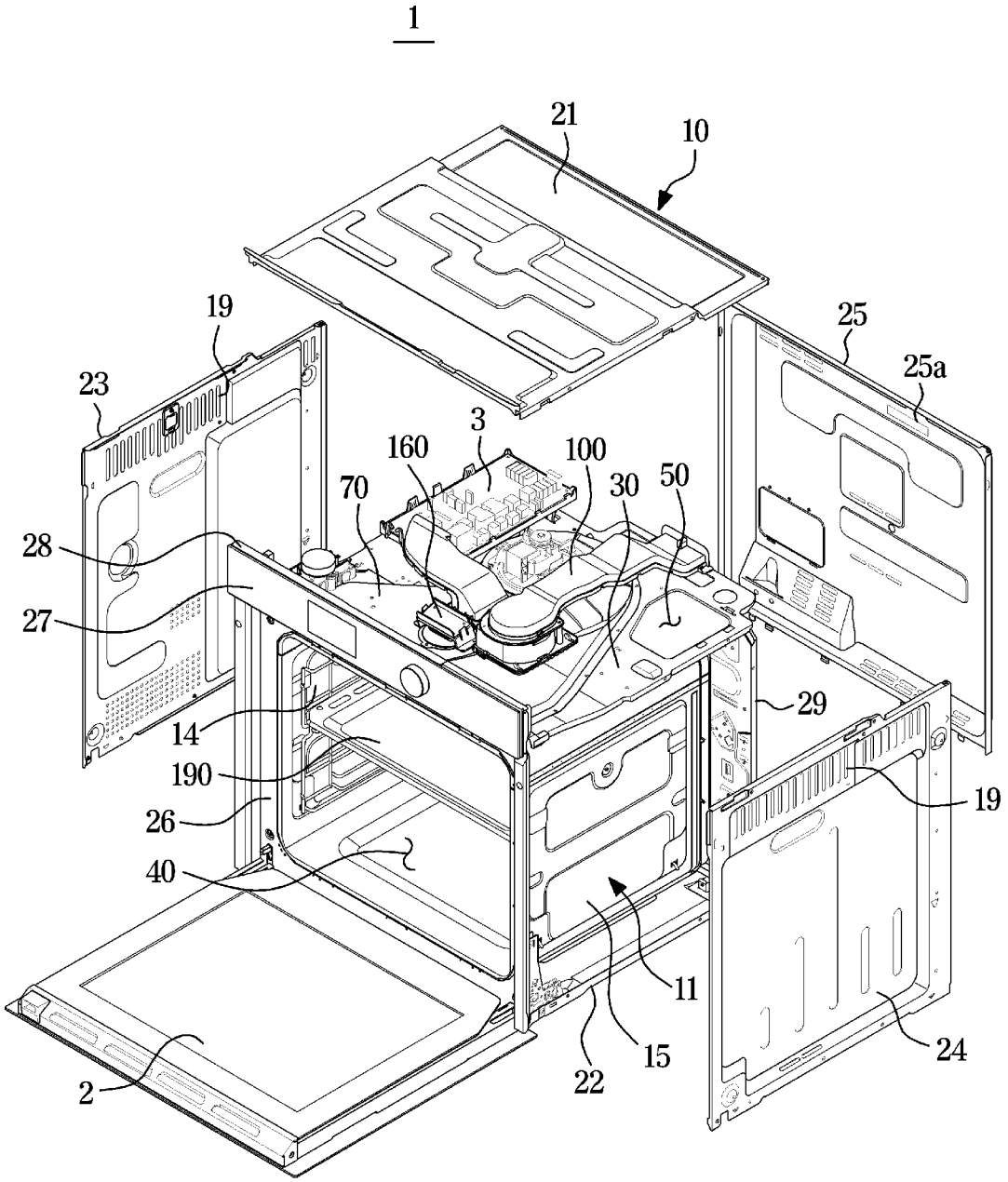
FIG. 2 is an exploded view illustrating an outer case of the cooking apparatus according to an embodiment of the disclosure.
Figure 3:
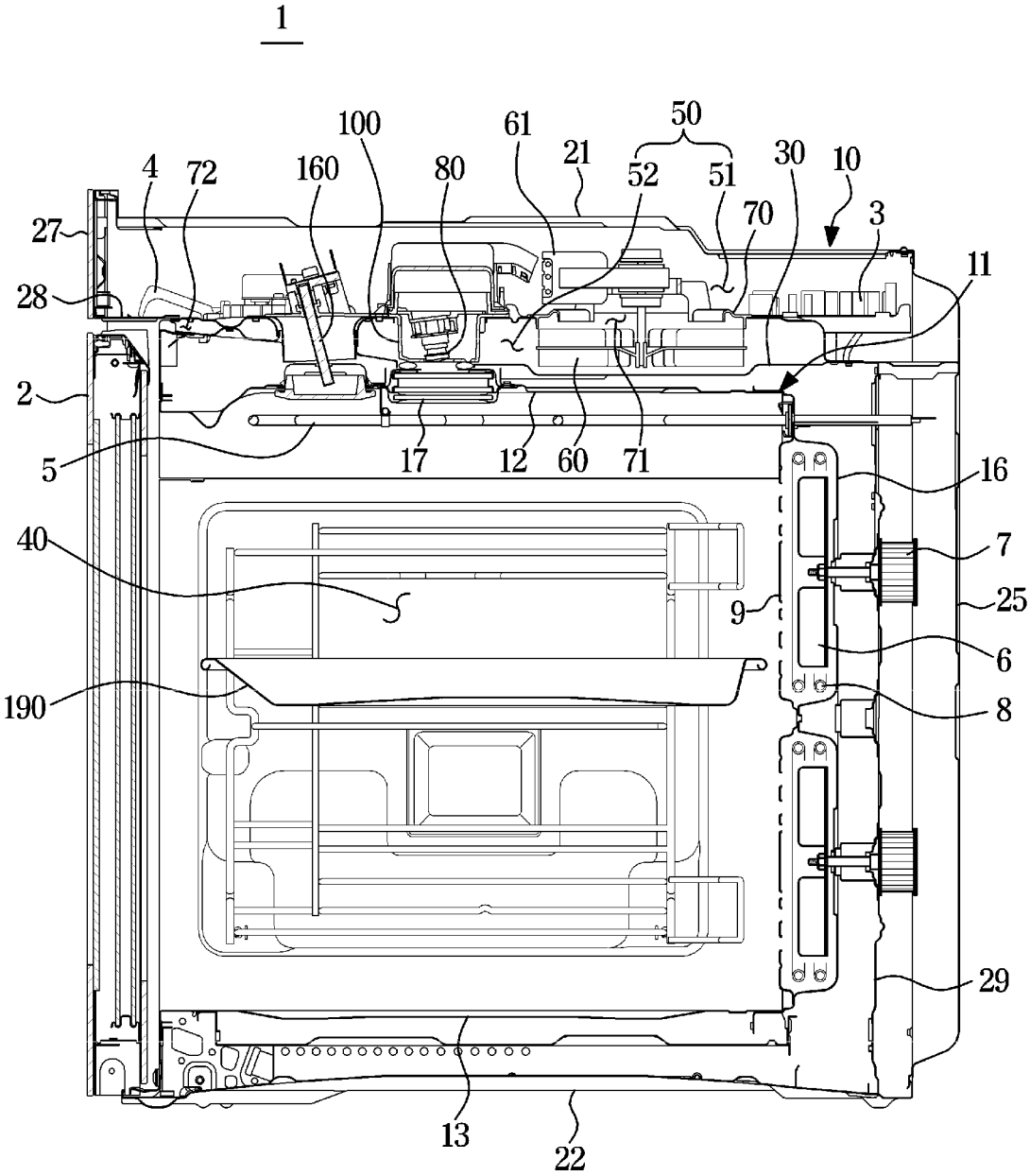
FIG. 3 is a longitudinal cross-sectional view of the cooking apparatus according to an embodiment of the disclosure.
Figure 4:
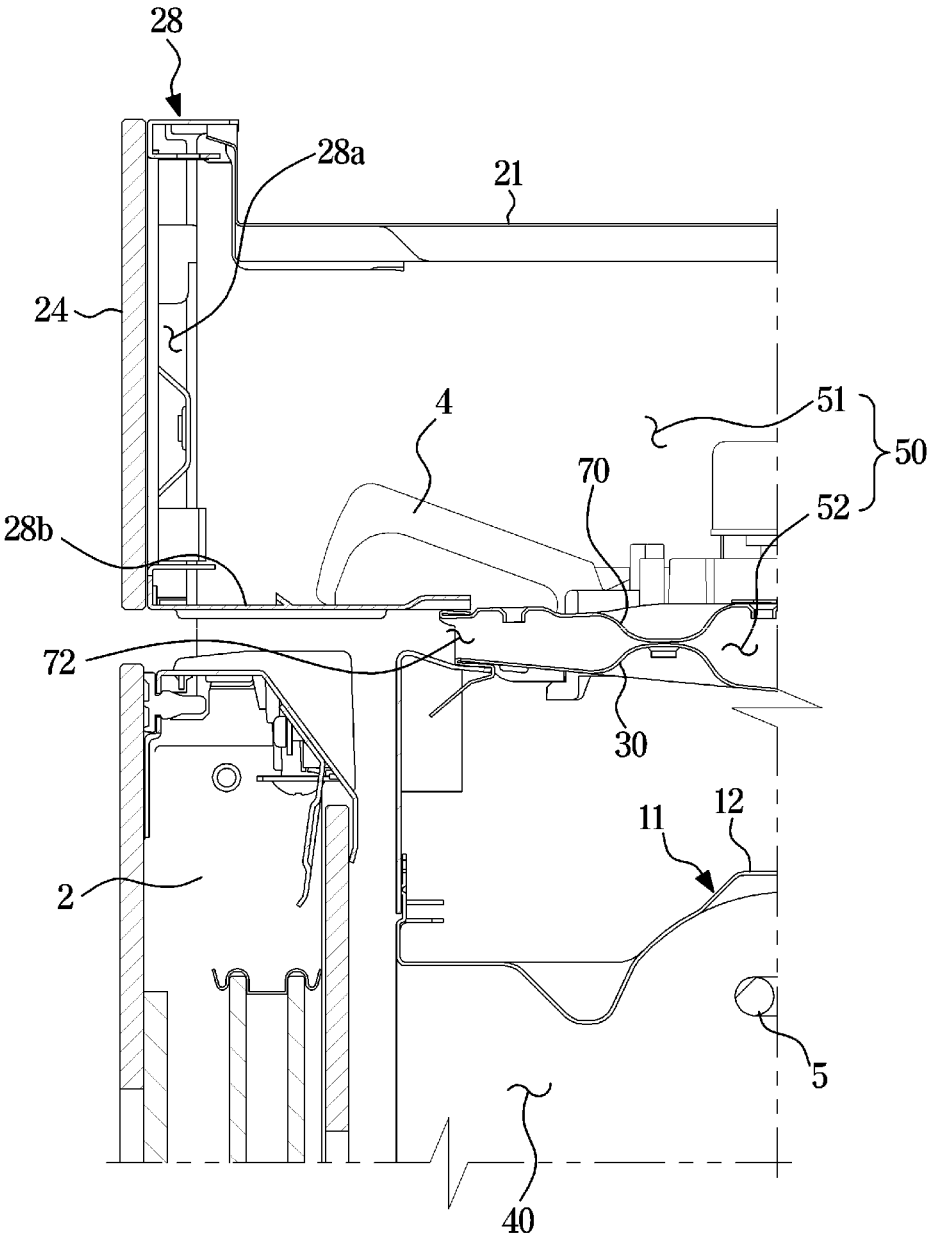
FIG. 4 is a cross-sectional view illustrating a front upper portion of the cooking apparatus according to an embodiment of the disclosure.

FIG. 1 is a view illustrating an appearance of a cooking apparatus according to an embodiment of the disclosure. FIG. 2 is an exploded view illustrating an outer case of the cooking apparatus according to an embodiment of the disclosure. FIG. 3 is a longitudinal cross-sectional view of the cooking apparatus according to an embodiment of the disclosure. FIG. 4 is a cross-sectional view illustrating a front upper portion of the cooking apparatus according to an embodiment of the disclosure.

As illustrated in FIGS. 1 to 4, the cooking apparatus 1 may include a main body 10 including an inner case 11, a cooking chamber 40 formed inside the inner case 11, and an electronic compartment 50 formed outside the inner case 11.

The inner case 11 may define the cooking chamber 40 and the electronic compartment 50. The inner case 11 may have a substantially box shape. The inner case 11 may include an upper wall 12, a lower wall 13, a left wall 14, a right wall 15, and a rear wall 16.

The cooking chamber 40 may cook food at a high temperature. The cooking chamber 40 may be formed in such a way that a front side is opened to take in and out of food. Heating devices 5 and 8 may be provided in the cooking chamber 40 to heat the cooking chamber 40. The heating devices 5 and 8 may include an electric heater including a heating element and configured to generate heat when electricity is supplied. However, the heating devices 5 and 8 are not limited thereto, and may include a gas burner configured to generate heat using gas or a magnetron configured to generate microwaves.

The heating devices 5 and 8 may include an upper heating device 5 and a fan heating device 8. The upper heating device 5 may be disposed in an upper portion of the cooking chamber 40 to heat the food from an upper side of the food. The fan heating device 8 may be disposed around a convection fan 6 configured to allow convention of the air inside the cooking chamber 40.

According to embodiments, the cooking apparatus 1 may include at least one of the upper heating device 5 and the fan heating device 8. In addition, the cooking apparatus 1 may further include a lower heating device provided in a lower portion of the cooking chamber 40.

The convection fan 6 for convection of air inside the cooking chamber 40 may be provided in the cooking chamber 40. The convection fan 6 may be disposed at the rear of the cooking chamber 40. The convection fan 6 may be covered and protected by a fan cover 9. The fan cover 9 may be coupled to the rear wall 16 of the inner case 11. A through-hole may be formed in the fan cover 9 to allow air to flow. The convection fan 6 may be driven by a convection fan motor 7. The convection fan motor 7 may be supported on a support plate 29 disposed between the rear wall 16 of the inner case 11 and a rear plate 25 of the outer case.

A shelf 190 on which food to be cooked is placed may be disposed in the cooking chamber 40.

Various electronic components such as a circuit board 3 configured to control an operation of the cooking apparatus 1 may be arranged in the electronic compartment 50. According to embodiments, a steam generator (not shown) configured to generate steam may be provided in the electronic compartment 50. According to embodiments, an automatic opening and closing device (not shown) configured to automatically open and close a door 2 may be provided in the electronic compartment 50.

The electronic compartment 50 may be formed to surround the cooking chamber 40. The electronic compartment 50 may insulate between the cooking chamber 40 and an outer case of the main body 10 to prevent heat inside the cooking chamber 40 from being discharged to the outside of the main body 10 as it is. Air may flow in the electronic compartment 50 for insulation. A separate insulating material (not shown) may be provided in the electronic compartment 50 to surround the inner case 11 for insulation. The insulating material may be formed of glass fiber, asbestos, or the like.

The main body 10 may include the outer case forming an exterior of the cooking apparatus 1. The inner case 11 may be received inside the outer case. The electronic compartment 50 may be formed between the inner case 11 and the outer case. The outer case may include an upper plate 21, a lower plate 2, a left plate 23, a right plate 24, the rear plate 25, and a front plate 26. A through-hole 19 through which air flows into the electronic compartment 50 may be formed in the left plate 23, the right plate 24, the rear plate 25, and the like. According to embodiments, the through-hole 19 may also be formed in the upper plate 21 or the lower plate 22.

The cooking apparatus 1 may include a control panel 27. The control panel 27 may include a display configured to display various operation information of the cooking apparatus 1 and an inputter through which a user can input operation commands. The inputter may include a touch panel. The inputter may include a button or a knob.

The control panel 27 may be provided on a front upper portion of the cooking apparatus 1. The control panel 27 may be mounted on a panel bracket 28 coupled to the main body 10. The control panel 27 may be mounted on a front surface of the panel bracket 28. The panel bracket 28 may include a bracket opening **28*a* to allow at least a portion of a rear surface of the control panel 27 to be cooled by an electronic compartment cooling fan 60. A bottom member 28*b* of the panel bracket 28 may be positioned in front of an electronic compartment duct 70 to be a height corresponding to an upper surface of the electronic compartment duct 70. The bottom member 28*b* of the panel bracket 28 may guide air discharged toward the front of the main body 10 through a discharge port 72 of the electronic compartment duct 70**.

The cooking apparatus 1 may include a door 2 provided on the front surface of the main body 10 to open and close the cooking chamber 40. The door 2 may be rotatably provided on the front surface of the main body 10. The door 2 may be provided to be opened and closed while rotating in an up and down direction with respect to a lower end.

A locking device 4 configured to lock the door 2 while the door 2 is closed may be provided in the electronic compartment 50.

The cooking apparatus 1 may include a base plate 30 provided in the electronic compartment 50 to allow various components of the electronic compartment 50 to be installed. The base plate 30 may be provided above the inner case 11 to be spaced apart from the inner case 11 by a predetermined distance. The insulating material (not shown) may be provided or an air heat insulating layer may be formed between the base plate 30 and the upper wall 12 of the inner case 11.

The electronic compartment duct 70 may be coupled to an upper surface of the base plate 30. The electronic compartment duct 70 may divide the electronic compartment 50 into an electronic component space 51 and an exhaust space 52. The exhaust space 52 may be formed between the electronic compartment duct 70 and the base plate 30. The base plate 30 may include a plate opening 31 formed to allow a camera 80 to image the cooking chamber 40. The plate opening 31 may be formed at a position corresponding to a transparent member 17 provided on the upper wall 12 of the inner case 11.

The electronic compartment duct 70 may include a suction port 71 through which air is sucked from the electronic component space 51 to the exhaust space 52. The electronic compartment duct 70 may include the discharge port 72 configured to discharge air in the exhaust space 52 to the outside of the electronic compartment duct 70. Air in the electronic compartment 50 may be discharged to the outside of the main body 10 through the electronic compartment duct 70. The discharge port 72 may be formed in front of the electronic compartment duct 70. Thus, air in the electronic compartment 50 may be discharged to the front of the main body 10.

The electronic compartment duct 70 may include a housing duct opening 73 through which a housing 110 of a camera cooling duct 100 passes, and a lighting duct opening 74 through which a lighting device 160 passes.

The cooking apparatus 1 may include the electronic compartment cooling fan 60 configured to cool the electronic compartment 50. The electronic compartment cooling fan 60 may be driven by an electronic compartment cooling fan motor 61. The electronic compartment cooling fan motor 61 may be mounted on a motor mount 75 coupled to the electronic compartment duct 70. The electronic compartment cooling fan 60 may cool the electronic compartment 50 by moving air inside the electronic compartment 50.

The electronic compartment cooling fan 60 may be provided in the electronic compartment 50. The electronic compartment cooling fan 60 may be disposed adjacent to the suction port 71 of the electronic compartment duct 70. The electronic compartment cooling fan 60 may include a centrifugal fan configured to suck air in an axial direction and discharge the air in a radial direction.

The electronic compartment cooling fan 60 may suck air from the outside of the main body 10 into the electronic compartment 50 through the through-hole 19 formed in the left plate 23, the right plate 24, and the rear plate 25. The electronic compartment cooling fan 60 may cool the entire electronic compartment 50 by forming air flow throughout the electronic compartment 50.

When the electronic compartment cooling fan 60 operates, the air outside the main body 10 may be sucked into the electronic component space 51 of the electronic compartment 50, and the air in the electronic component space 51 may be sucked into the exhaust space 52 formed by the electronic compartment duct 70. Air in the exhaust space 52 may be discharged toward the front of the main body 10.

The cooking apparatus 1 may include the camera 80 configured to image the inside of the cooking chamber 40. The camera 80 may be disposed in the electronic compartment 50. The camera 80 may image the inside of the cooking chamber 40 through the upper wall 12 of the inner case 11. For this, the upper wall 12 of the inner case 11 may include the transparent member 17 through which the camera 80 sees through. The camera 80 may be disposed above the transparent member 17 and may image the inside of the cooking chamber 40 through the transparent member 17.

The cooking apparatus 1 may include the lighting device 160 to brightly illuminate the cooking chamber 40 when the camera 80 images the cooking chamber 40. The lighting device 160 may be disposed in front of the camera 80. The lighting device 160 may be installed to penetrate the electronic compartment duct 70 and the base plate 30. The lighting device 160 may include a light source such as a light emitting diode (LED) and a light guide plate provided to guide light emitted from the light source.

The cooking apparatus 1 may include a camera cooling fan 90 (refer to FIG. 8) configured to intensively cool the camera 80.

The cooking apparatus 1 may include the camera cooling duct 100 configured to, when the camera cooling fan 90 is driven, allow air outside the main body 10 to be sucked to cool the camera 80 and to be discharged to the electronic component space 51 of the electronic compartment 50.

Figure 5:
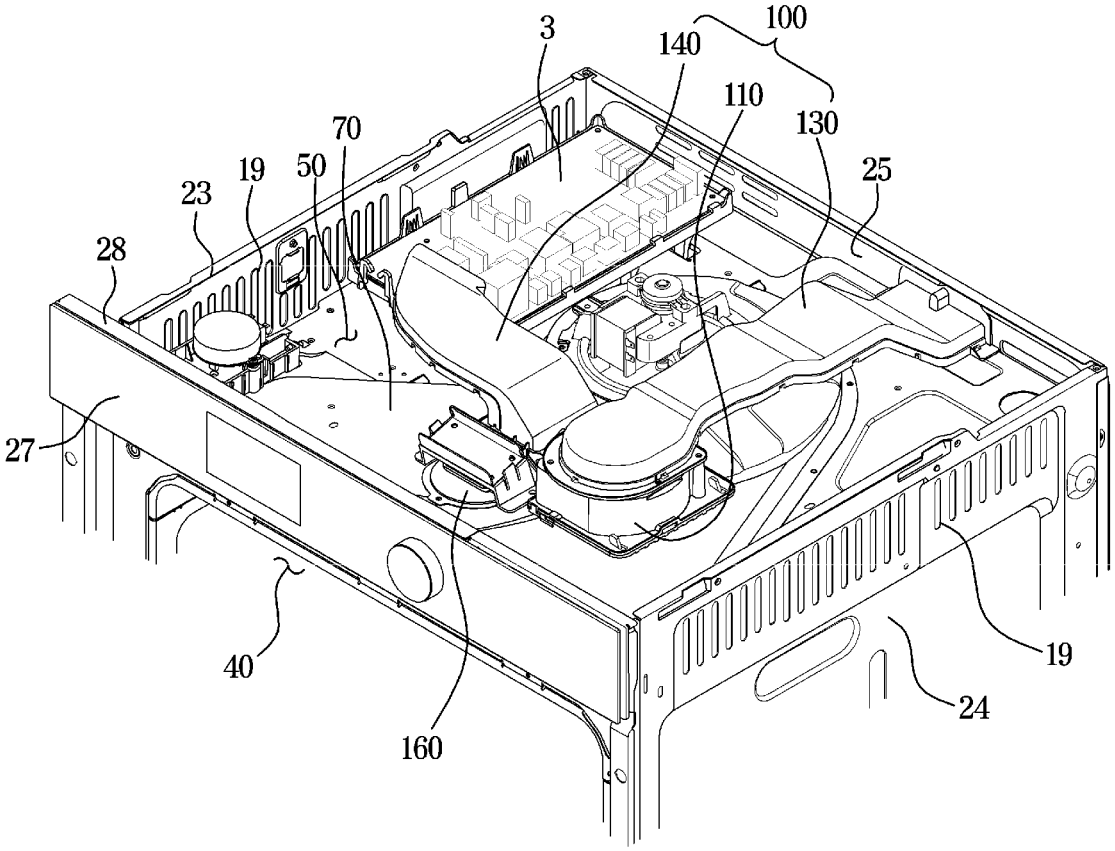
FIG. 5 is a view illustrating a state in which an upper plate of the cooking apparatus according to an embodiment of the disclosure is removed.
Figure 6:
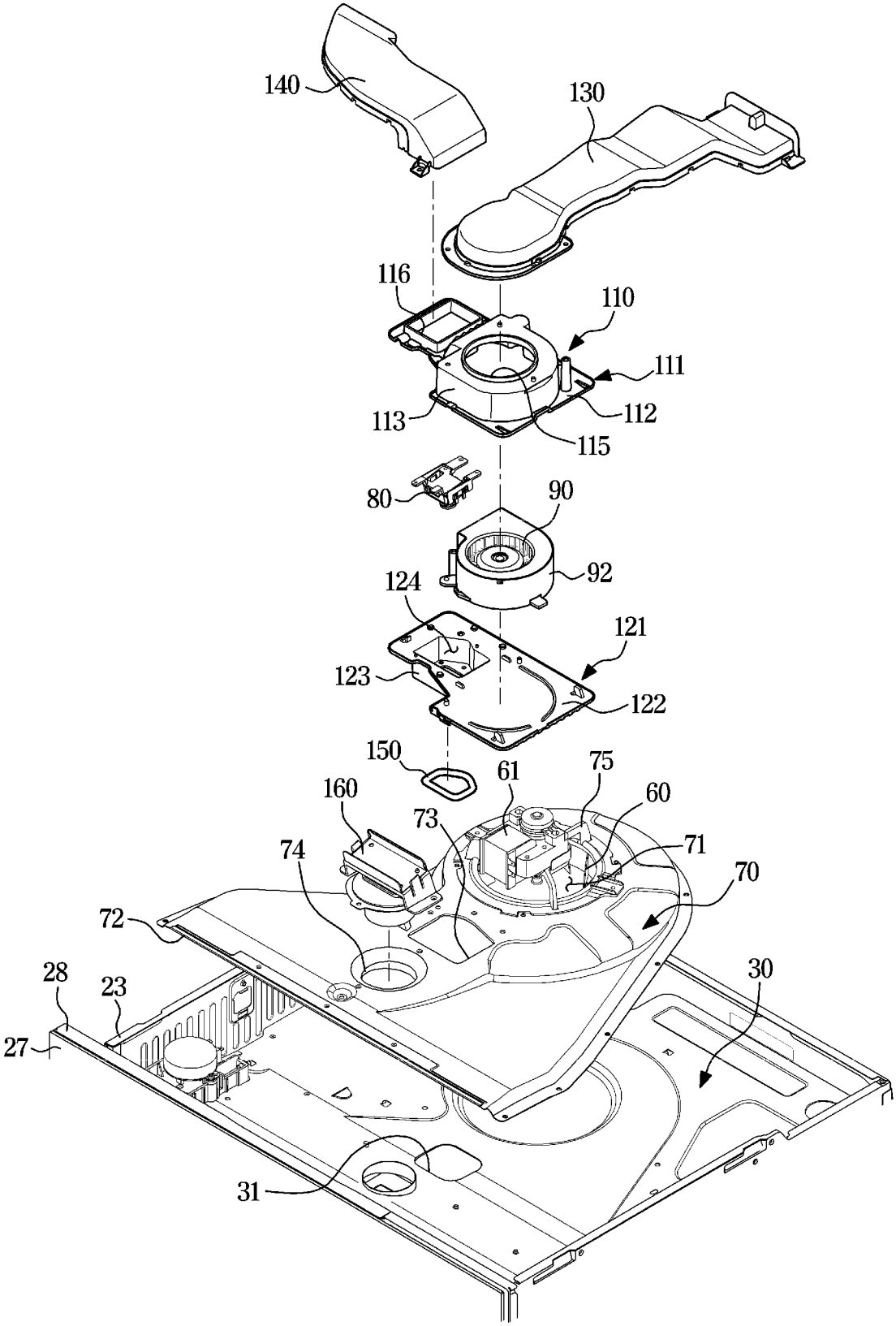
FIG. 6 is an exploded view illustrating main components of a camera cooling duct according to an embodiment of the disclosure.
Figure 7:
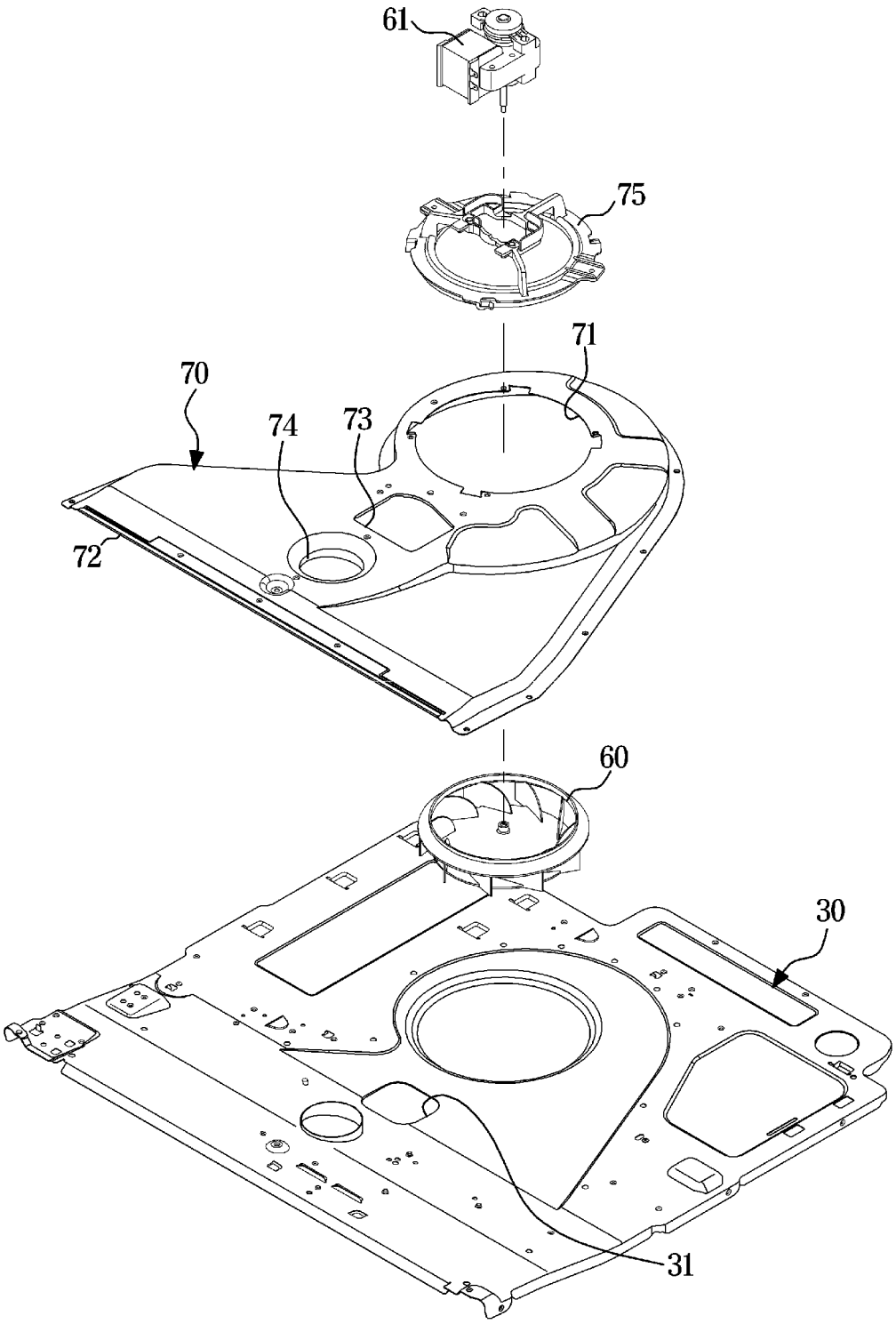
FIG. 7 is a view illustrating an electronic compartment cooling fan and an electronic compartment cooling duct according to an embodiment of the disclosure.
Figure 8:
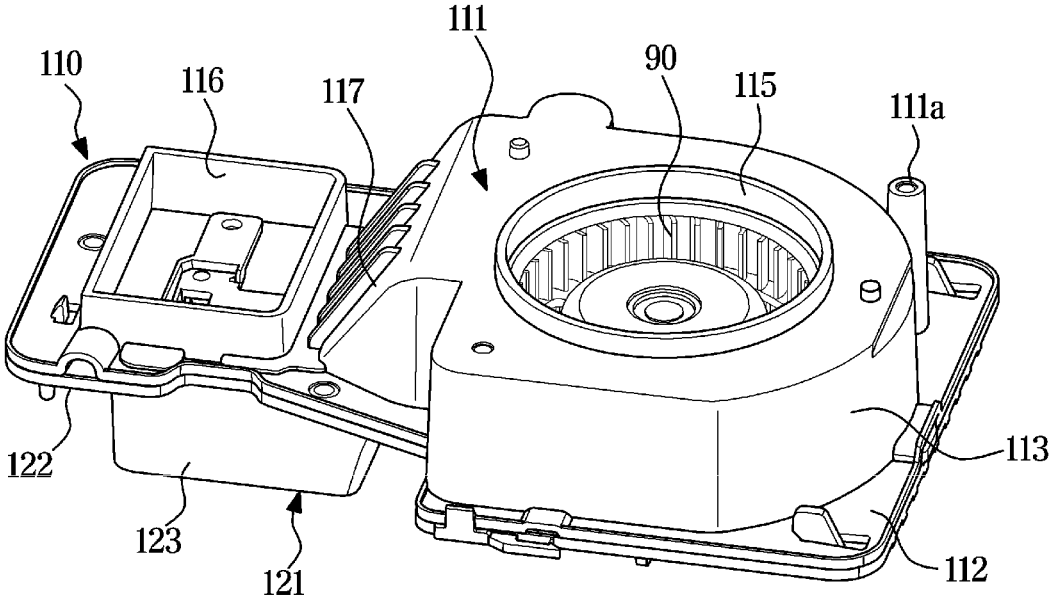
FIG. 8 is a view illustrating a housing of a camera cooling duct according to an embodiment of the disclosure.
Figure 9:
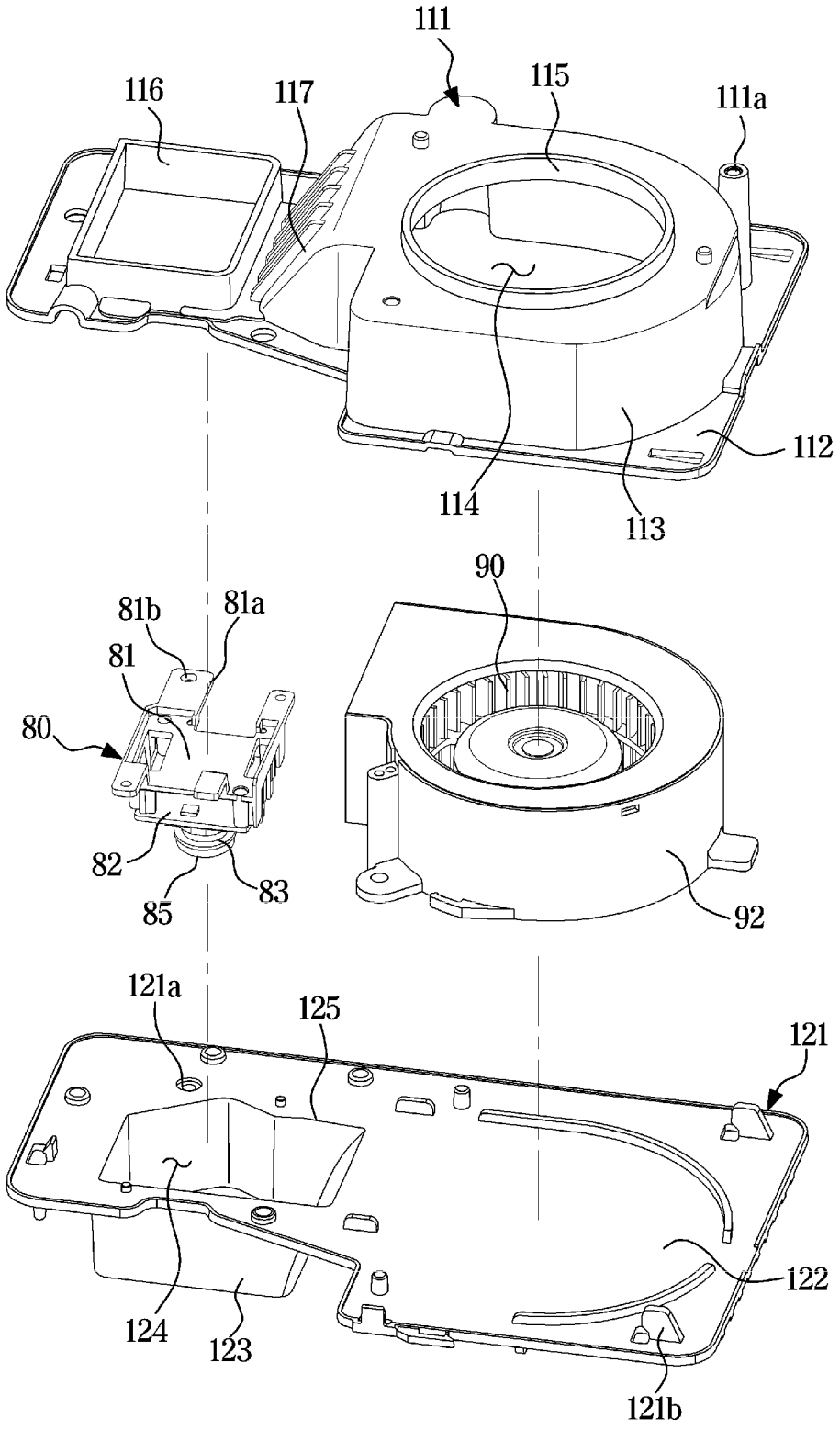
FIG. 9 is an exploded view illustrating the housing of the camera cooling duct according to an embodiment of the disclosure.
Figure 10:
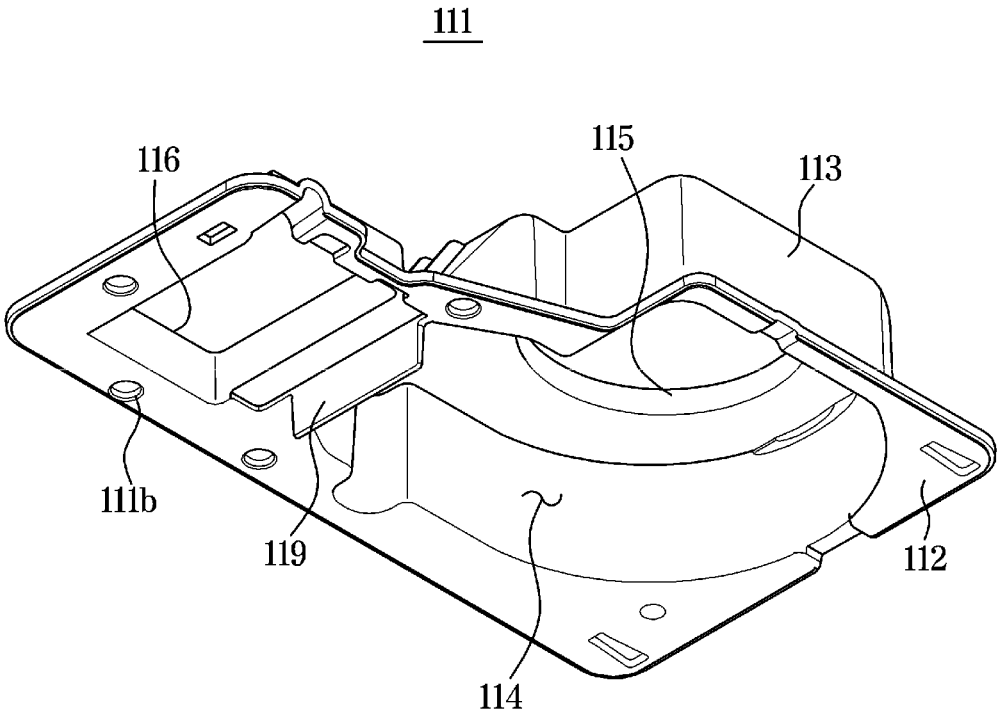
FIG. 10 is a perspective view illustrating a lower surface of an upper housing of the housing according to an embodiment of the disclosure.
Figure 11:
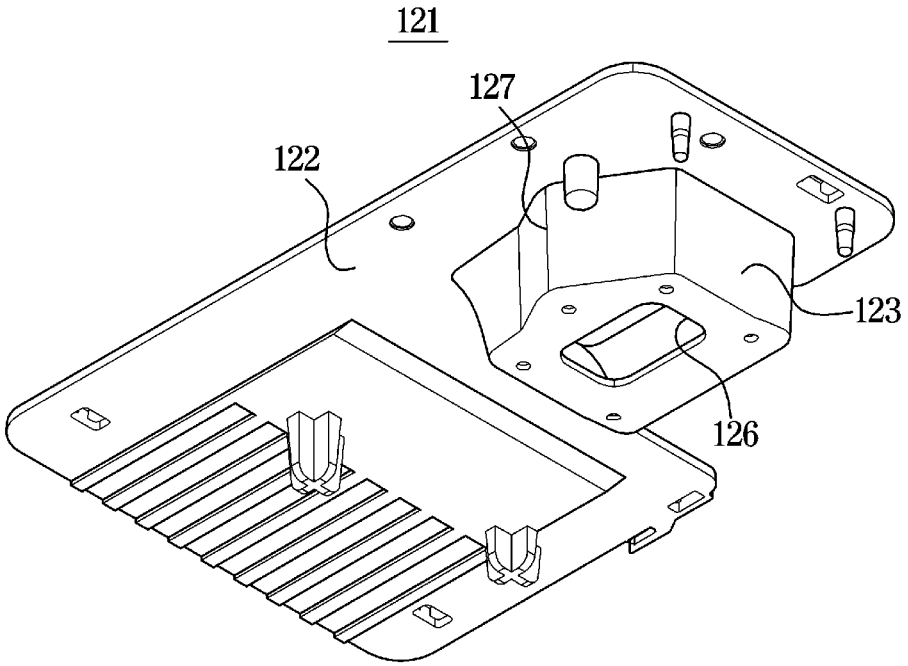
FIG. 11 is a perspective view illustrating a lower surface of a lower housing of the housing according to an embodiment of the disclosure.
Figure 12:
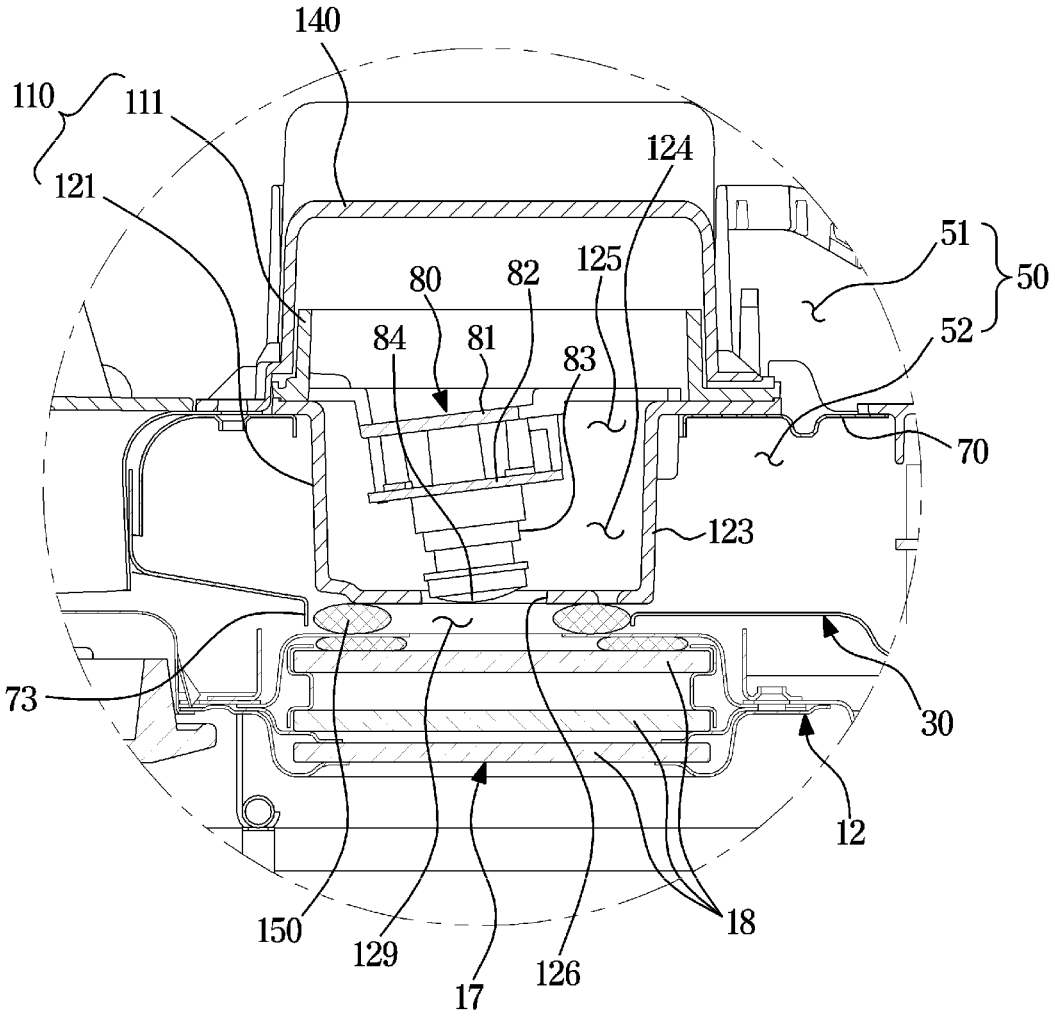
FIG. 12 is a cross-sectional view illustrating a vicinity of a camera of the cooking apparatus according to an embodiment of the disclosure, particularly, a cross-sectional view taken along a front and rear direction of a main body.
Figure 13:
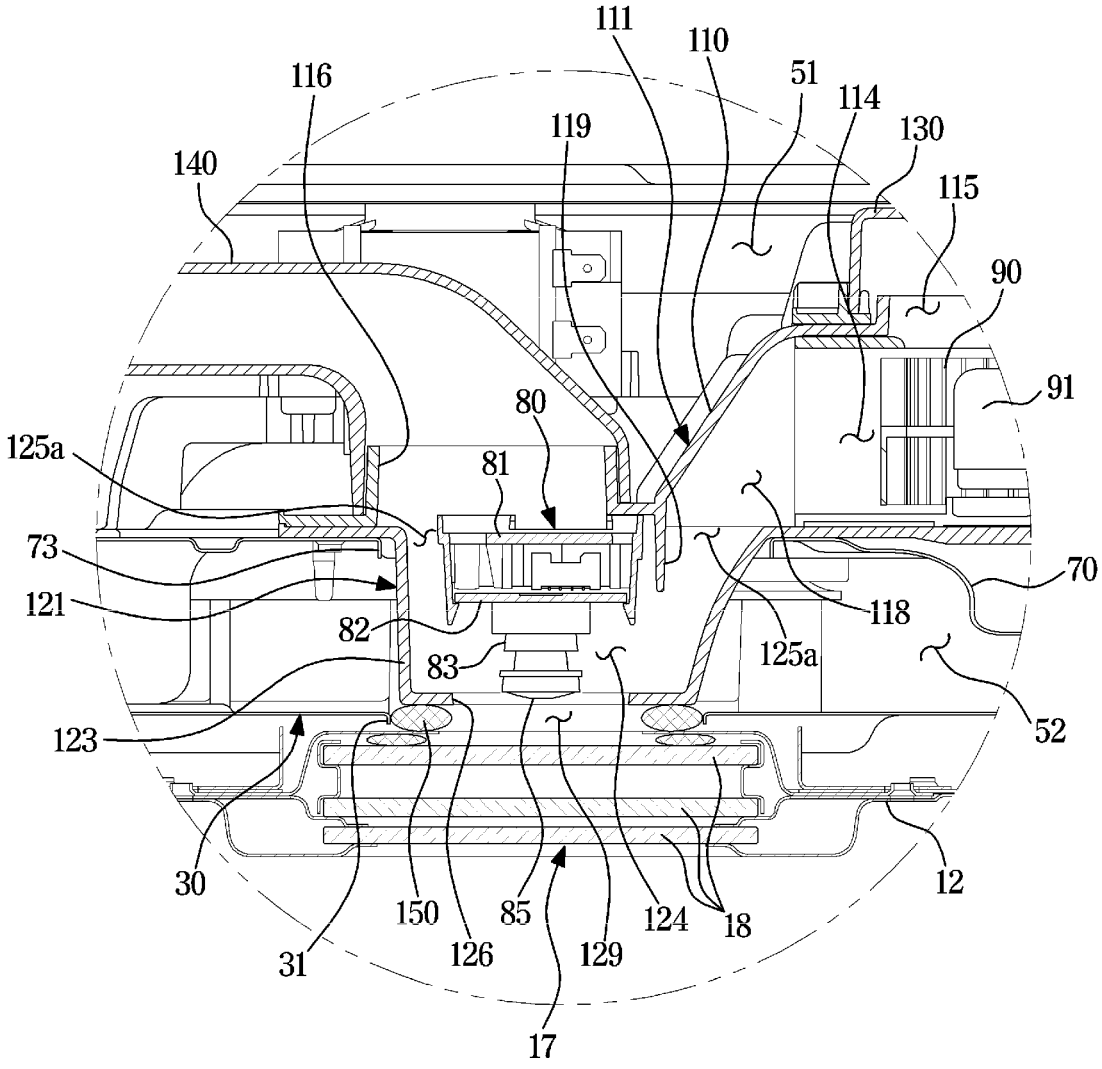
FIG. 13 is a cross-sectional view illustrating the vicinity of the camera of the cooking apparatus according to an embodiment of the disclosure, particularly, a cross-sectional view taken along a left and right direction of the main body.

FIG. 5 is a view illustrating a state in which an upper plate of the cooking apparatus according to an embodiment of the disclosure is removed. FIG. 6 is an exploded view illustrating main components of a camera cooling duct according to an embodiment of the disclosure. FIG. 7 is a view illustrating an electronic compartment cooling fan and an electronic compartment cooling duct according to an embodiment of the disclosure. FIG. 8 is a view illustrating a housing of a camera cooling duct according to an embodiment of the disclosure. FIG. 9 is an exploded view illustrating the housing of the camera cooling duct according to an embodiment of the disclosure. FIG. 10 is a perspective view illustrating a lower surface of an upper housing of the housing according to an embodiment of the disclosure. FIG. 11 is a perspective view illustrating a lower surface of a lower housing of the housing according to an embodiment of the disclosure. FIG. 12 is a cross-sectional view illustrating a vicinity of a camera of the cooking apparatus according to an embodiment of the disclosure, particularly, a cross-sectional view taken along a front and rear direction of a main body. FIG. 13 is a cross-sectional view illustrating the vicinity of the camera of the cooking apparatus according to an embodiment of the disclosure, particularly, a cross-sectional view taken along a left and right direction of the main body.

As illustrated in FIGS. 5 to 13, the camera cooling duct 100 may include the housing 110, a suction duct 130 coupled to one side of the housing 110, and a discharge duct 140 coupled to the other side of the housing 110. According to embodiments, the housing 110, the suction duct 130, and the discharge duct 140 may be formed separately and assembled with each other. According to embodiments, the housing 110, the suction duct 130, and the discharge duct 140 may be integrally formed with each other.

The housing 110 may include a camera receiving space 124 provided to receive the camera 80 and a cooling fan receiving space 114 provided to receive the camera cooling fan 90. The suction duct 130 may be coupled to the housing 110 to suck air outside the main body 10 and guide the air to the camera receiving space 124. The discharge duct 140 may be coupled to the housing 110 to discharge air from the camera receiving space 124 of the housing 110 to the electronic component space 51 of the electronic compartment 50.

However, according to embodiments, the discharge duct 140 may be omitted. In this case, air in the camera receiving space 124 of the housing 110 may be directly discharged from the housing 110 to the electronic component space 51.

The housing 110 may be coupled to an upper surface of the electronic compartment duct 70. An inlet 115 through which air flows into the housing 110 and an outlet 116 through which air flows out of the inside of the housing 110 may be formed on an upper surface of the housing 110. An exit 137 (refer to FIG. 14) of the suction duct 130 may be connected to the inlet 115. An entrance 144 (refer to FIG. 15) of the discharge duct 140 may be connected to the outlet 116.

The housing 110 may be formed by combining an upper housing 111 and a lower housing 121. The upper housing 111 may include an upper housing base 112, and the lower housing 121 may include a lower housing base 122 coupled to the upper housing base 112. A coupling protrusion **121*b* of the lower housing base 122 may be inserted into the upper housing base 112 to allow the upper housing 111 and the lower housing 121** to be coupled to each other. However, the coupling method is not limited thereto and the upper housing 111 and the lower housing 121 may be coupled to each other by various other coupling methods.

However, unlike the embodiment, the housing 110 may be integrally formed.

The above-described inlet 115 and outlet 116 may be formed in the upper housing 111. The upper housing 111 may include a cooling fan receiving member 113 protruding upward from the upper housing base 112 to form a cooling fan receiving space 114. The cooling fan receiving space 114 may be formed inside the cooling fan receiving member 113. That is, the cooling fan receiving member 113 may be formed to surround the cooling fan receiving space 114.

The camera cooling fan 90, a camera cooling fan motor 91 configured to drive the camera cooling fan 90, and a fan case 92, in which the camera cooling fan 90 is mounted, may be received in the cooling fan receiving space 114. The camera cooling fan 90 may include a centrifugal fan configured to suck air in an axial direction and discharge the air in a radial direction. The cooling fan receiving space 114 may be located below the inlet 115.

The suction duct 130 may be coupled to the upper housing 111. For this, a suction duct coupler 111*a* may be formed in the upper housing 111. The discharge duct 140 may be coupled to the upper housing 111. For this, a discharge duct coupler 111*b* may be formed in the upper housing 111.

The lower housing 121 may include a camera receiving member 123 protruding downward from the lower housing base 122 to form the camera receiving space 124. The camera receiving member 123 may pass through the housing duct opening 73 of the electronic compartment duct 70. The camera receiving member 123 may pass through the housing duct opening 73 of the electronic compartment duct 70 and be disposed in the exhaust space 52 inside the electronic compartment duct 70.

The camera receiving space 124 may be formed inside the camera receiving member 123. That is, the camera receiving member 123 may be formed to surround the camera receiving space 124.

The lower housing base 122 may be located on the upper surface of the electronic compartment duct 70, and the camera receiving member 123 may protrude downward toward the exhaust space 52 of the electronic compartment duct 70. Accordingly, the camera receiving space 124 formed inside the camera receiving member 123 may be located at a height corresponding to the exhaust space 52. The camera receiving space 124 may be located below the outlet 116.

The camera 80 may be coupled to the lower housing 121 to be disposed in the camera receiving space 124. The camera 80 may be coupled to the lower housing base 122. For this, a coupling hole 121*a* may be formed in the lower housing base 122.

The camera 80 may include a camera substrate 82 including an image sensor, a barrel 83 extending downward from the camera substrate 82 and having a cylindrical shape, a lens 85 disposed at an end of the barrel 83, and a camera bracket 81 provided to mount the camera 80 to the housing 110.

The camera bracket 81 may be coupled to the lower housing 121. The camera bracket 81 may include a camera coupler 81*a* protruding laterally toward the lower housing base 122, and a camera coupling hole 82*b* formed in the camera coupler 81*a*. The camera coupling hole 82*b* of the camera 80 and the coupling hole 121*a* of the lower housing base 122 may be coupled through a separate fastening member such as a screw, pin, bolt, or rivet.

The camera receiving space 124 may be located downstream of the cooling fan receiving space 114 in the direction of air flow. That is, air introduced into the housing 110 through the inlet 115 may flow into the camera receiving space 124 via the cooling fan receiving space 114. Air introduced into the camera receiving space 124 may cool the camera 80 and exit through the outlet 116.

A connection flow path 118 provided to guide air of the cooling fan receiving space 114 to the camera receiving space 124 may be formed in the upper housing 111.

The camera receiving space 124 and the cooling fan receiving space 114 may be horizontally and vertically spaced apart from each other. That is, the cooling fan receiving space 114 may be disposed above the camera receiving space 124. As described above, the camera receiving space 124 may be formed at a height corresponding to the exhaust space 52, and the cooling fan receiving space 114 may be formed at a higher position than the exhaust space 52.

The camera receiving space 124 and the cooling fan receiving space 114 may be arranged along the left and right direction of the main body 10. In this embodiment, the camera receiving space 124 may be disposed on the left side of the cooling fan receiving space 114, but according to embodiments, the camera receiving space 124 may be disposed on the right side of the cooling fan receiving space 114.

Because the camera receiving space 124 and the cooling fan receiving space 114 are horizontally and vertically spaced apart from each other, the connection flow path 118 connecting the camera receiving space 124 and the cooling fan receiving space 114 may be formed to be inclined. The upper housing 111 may include an inclined surface 117 to allow the connection flow path 118 to be inclined therein.

The lower housing 121 may include an upper opening 125 formed in an upper portion of the camera receiving space 124. Air may flow into the camera receiving space 124 through the upper opening 125, and air may flow out of the camera receiving space 124 through the upper opening 125. That is, the camera receiving space 124 may include an upper suction and upper discharge structure.

The upper housing 111 may include a guide rib 119 provided to divide the upper opening 125 into one area 125*a* (refer to FIG. 13) and other area 125*b* (refer to FIG. 13). The guide rib 119 may protrude downward toward the upper opening 125 from an upper inner surface of the upper housing 111. The guide rib 119 may be formed between the connection flow path 118 and the upper opening 125.

By the guide rib 119, air in the cooling fan receiving space 114 may be introduced into the camera receiving space 124 through the area 125*a* of the upper opening 125 and the air in the camera receiving space 124 may flow out of the camera receiving space 124 through the other area 125*b* of the upper opening 125.

In addition, the guide rib 119 may guide air, which is introduced into the camera receiving space 124, to the lower side of the camera 80. That is, the air introduced into the camera receiving space 124 may be guided to the lateral side or the lower side of the camera 80 by the guide rib 119, and thus the camera 80 may be uniformly cooled as a whole. Alternatively, the camera 80 may be cooled sequentially from the bottom to the top, that is, in the direction from the lens 85 to the camera substrate 82.

As described above, the lower portion of the camera 80, which is close to the cooking chamber 40 and thus receives the most heat, may be cooled first, and thus it is possible to increase a cooling efficiency of the camera 80.

The lower housing 121 may include a lower opening 126 formed in a lower portion of the camera receiving space 124. The lower opening 126 may be formed in a lower portion of the camera receiving member 123. The camera 80 received in the camera receiving space 124 may image the inside of the cooking chamber 40 through the lower opening 126.

The lower opening 126 may be open to allow air to flow. That is, a blocking member such as glass may not be provided in the lower opening 126. Because the blocking member such as glass is not provided in the lower opening 126, the camera 80 may be installed closer to the cooking chamber 40. According to this embodiment, the lens 85 of the camera 80 may be disposed at a height corresponding to the lower opening 126. According to embodiments, the lens 85 of the camera 80 may be disposed lower than the lower opening 126. Further, according to embodiments, a blocking member (not shown) may be provided in the lower opening 126 to block the lower opening 126. The blocking member may be formed of a transparent material.

A lower cooling flow path 129 may be formed between the lower opening 126 and the transparent member 17 provided on the upper wall 12 of the inner case 11.

Air sucked from the outside of the main body 10 by the camera cooling fan 90 may be supplied to the upper surface of the transparent member 17 through the lower cooling flow path 129 and thus the transparent member 17 may be cooled. Accordingly, it is possible to obtain an effect of blocking heat, which is to be transmitted to the camera 80, from the transparent member 17. In addition, the lens 85 at the bottom of the camera 80 may be cooled more efficiently by the air flow that descends to the transparent member 17 and then rises again.

In addition, foreign substances attached to the surface of the lens 85 may be effectively cleaned from the lens 85 by U-shaped airflow that descends and ascends around the lens 85.

The transparent member 17 may include at least one glass 18 mounted in an opening of the upper wall 12. At least one glass may be formed of heat-resistant tempered glass or borosilicate glass. An air insulation layer may be formed between at least one glass. However, the transparent member 17 may be formed of a material other than glass that is transparent and resistant to heat.

The cooking apparatus 1 may include a sealing member 150 provided to seal the lower cooling flow path 129 to prevent air in the lower cooling flow path 129 from leaking into the electronic compartment 50. When the air of the camera cooling duct 100 leaks into the exhaust space 52 of the electronic compartment 50 through the lower cooling flow path 129, a pressure loss in the camera cooling duct 100 may occur and the air may interrupt a flow of air discharged to the outside of the main body 10 through the exhaust space 52. That is, when the airflow through the camera cooling fan 90 and the camera cooling duct 100 is not separated from the airflow through the electronic compartment cooling fan 60 and the electronic compartment duct 70, each cooling efficiency may be reduced.

The sealing member 150 may seal the lower cooling flow path 129 to prevent air in the lower cooling flow path 129 from leaking into the electronic compartment 50. The sealing member 150 may be formed of an elastic material such as rubber, and may adhere between the lower surface of the housing 110 and the upper surface of the upper wall 12. Particularly, an upper surface of the sealing member 150 may be in close contact with the lower surface of the camera receiving member 123 of the housing 110, and a lower surface of the sealing member 150 may be in close contact with an upper surface of the glass 18 forming the upper wall 12 or the transparent member 17.

The sealing member 150 may have a ring shape including a hollow 151, and the camera 80 may image the inside of the cooking chamber 40 through the hollow 151. The sealing member 150 may be mounted in the opening 31 of the base plate 30.

The suction duct 130 may be coupled to the housing 110 to suck air from the outside of the main body 10 and guide the air to the housing 110. The suction duct 130 may suck air from the outside of the main body 10 at a relatively lower temperature than that of the electronic compartment 50.

Therefore, the camera 80 may be cooled more effectively than other electronic components. The suction duct 130 may suck outside air from the rear of the main body 10. For this, the suction duct 130 may be coupled to the rear plate 25 forming the rear surface of the main body 10. An outside air inlet 25*a* (refer to FIG. 16) may be formed in the rear plate 25 to allow air outside the main body 10 to be sucked. The outside air inlet 25*a* may be formed to be more recessed than a periphery of the outside air inlet 25*a* to allow outside air to be efficiently sucked. The outside air inlet 25*a* may be formed to be recessed by 3 mm or more than the periphery of the outside air inlet 25*a*.

As mentioned above, because the suction duct 130 sucks air from the rear of the main body 10, foreign substances such as water or oil may be prevented from entering the camera 80 or the camera cooling fan 90.

The discharge duct 140 may be coupled to the housing 110 to discharge air, which cools the camera 80, from the housing 110. The discharge duct 140 may discharge air into the electronic component space 51 of the electronic compartment 50. As the discharge duct 140 discharges air into the electronic component space 51, the air discharged from the discharge duct 140 may not collide with or merge with air that is discharged to the front side along the exhaust space 52 of the electronic compartment duct 70 by the blowing force of the electronic compartment cooling fan 60. Therefore, it is possible to prevent a reduction in cooling efficiency of the electronic compartment performed by the electronic compartment cooling fan 60 and the electronic compartment duct 70.

Particularly, the discharge duct 140 may discharge air toward the circuit board 3 disposed in the electronic component space 51. The circuit board 3 is an electronic component that is relatively vulnerable to heat. As described above, because air flowing by the camera cooling fan 90 is directly sucked from the outside of the main body 10, the air may have a relatively lower temperature than air flowing by the electronic compartment cooling fan 60. Because the low-temperature air, which is moved by the camera cooling fan 90, is supplied toward the circuit board 3, the circuit board 3, which is vulnerable to heat, may be efficiently cooled.

However, the discharge duct 140 may be omitted from the camera cooling duct 100 according to embodiments. When the discharge duct 140 is omitted, air may be discharged into the electronic component space 51 through the outlet 116 of the housing 110.

Figure 14:
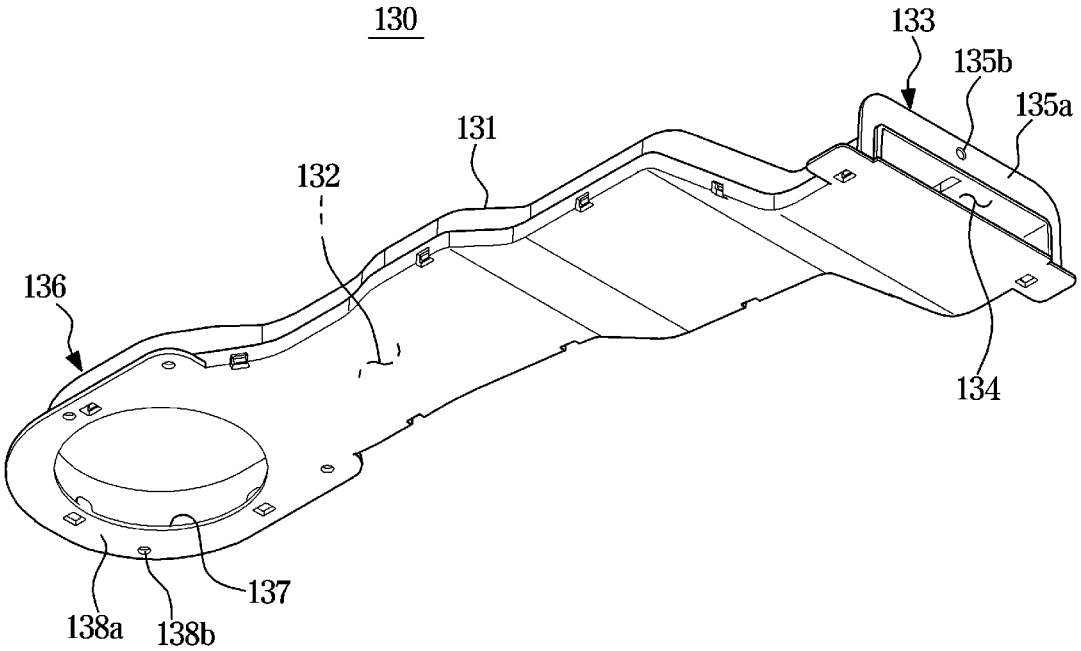
FIG. 14 is a view illustrating a suction duct of the camera cooling duct according to an embodiment of the disclosure.
Figure 15:
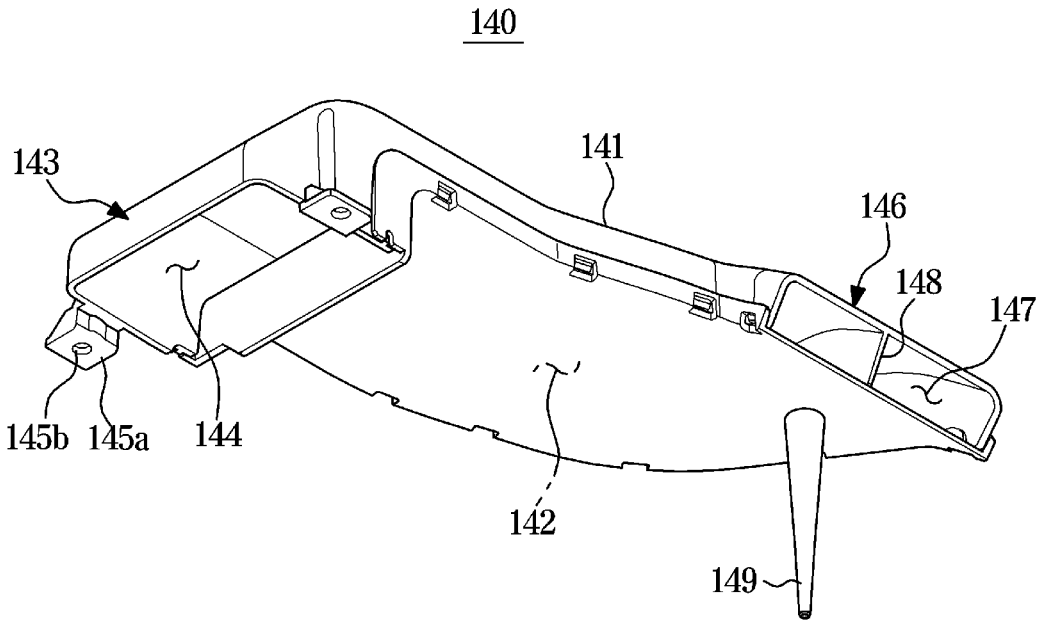
FIG. 15 is a view illustrating a discharge duct of the camera cooling duct according to an embodiment of the disclosure.

FIG. 14 is a view illustrating a suction duct of the camera cooling duct according to an embodiment of the disclosure. FIG. 15 is a view illustrating a discharge duct of the camera cooling duct according to an embodiment of the disclosure.

As illustrated in FIGS. 14 and 15, the suction duct 130 may include a suction duct body 131 including a suction flow path 132 formed therein. The suction duct body 131 may be integrally formed, or may be formed by coupling two or more parts.

An entrance 134 of the suction duct through which air is sucked to the suction flow path 132 may be formed on one end 133 of the suction duct 130. The entrance 134 of the suction duct may be connected to the outside air inlet 25*a* of the rear plate 25.

The exit 137 of the suction duct through which air is discharged from the suction flow path 132 may be formed on the other end 136 of the suction duct 130. The exit 137 of the suction duct may be connected to the inlet 115 of the housing 110.

The one end 133 of the suction duct 130 may be coupled to the rear plate 25 forming the rear surface of the main body 10. For this, a coupler 135*a* and a coupling hole 135*b* for coupling with the rear plate 25 may be formed at the one end of the suction duct 130. A separate fastening member such as a screw, pin, rivet, or bolt may be coupled to the coupling hole 135*b*.

The other end 136 of the suction duct 130 may be coupled to the housing 110. A coupler 138*a* and a coupling hole 138*b* for coupling with the housing 110 may be formed at the other end 136 of the suction duct 130.

The discharge duct 140 may include a discharge duct body 141 including a discharge flow path 142 formed therein. The discharge duct body 141 may be integrally formed, or may be formed by coupling two or more parts.

The entrance 144 of the discharge duct through which air flows into the discharge flow path 142 may be formed at one end 143 of the discharge duct 140. The entrance 144 of the discharge duct may be connected to the outlet 116 of the housing 110.

An exit 147 of the discharge duct through which air is discharged from the discharge flow path 142 may be formed at the other end 146 of the discharge duct 140. The exit 147 of the discharge duct may discharge air toward the circuit board 3.

The one end 143 of the discharge duct 140 may be coupled to the housing 110. For this, a coupler 145*a* and a coupling hole 145*b* for coupling with the housing 110 may be formed at the one end of the discharge duct 140.

The other end 146 of the discharge duct 140 may be supported on the base plate 30 disposed in the electronic compartment 50. Alternatively, the other end 146 of the discharge duct 140 may be supported by the electronic compartment duct 70 disposed in the electronic compartment 50.

A leg 149 extending downward to be supported by the base plate 30 or the electronic compartment duct 70 may be provided on the other end 146 of the discharge duct 140. A discharge guide 148 may be formed at the exit 147 of the discharge duct 140 to guide air discharged from the exit 147.

Figure 16:
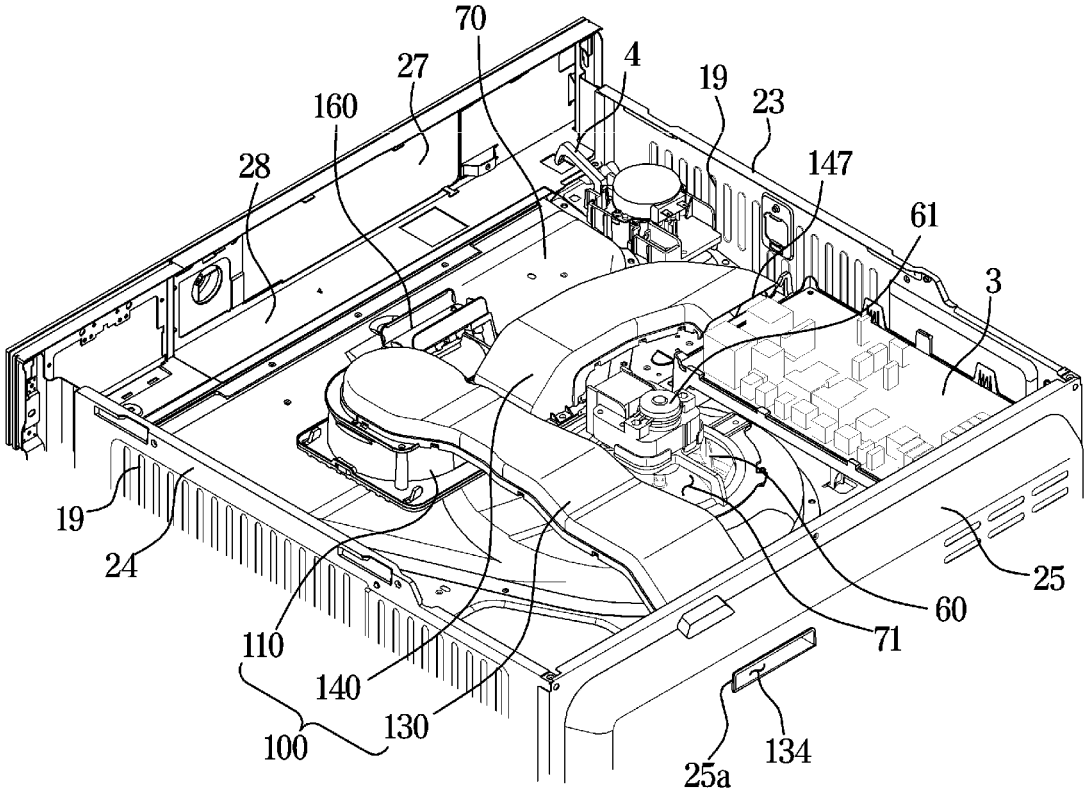
FIG. 16 is a view illustrating a state in which the upper plate of the cooking apparatus according to an embodiment of the disclosure is removed.
Figure 17:
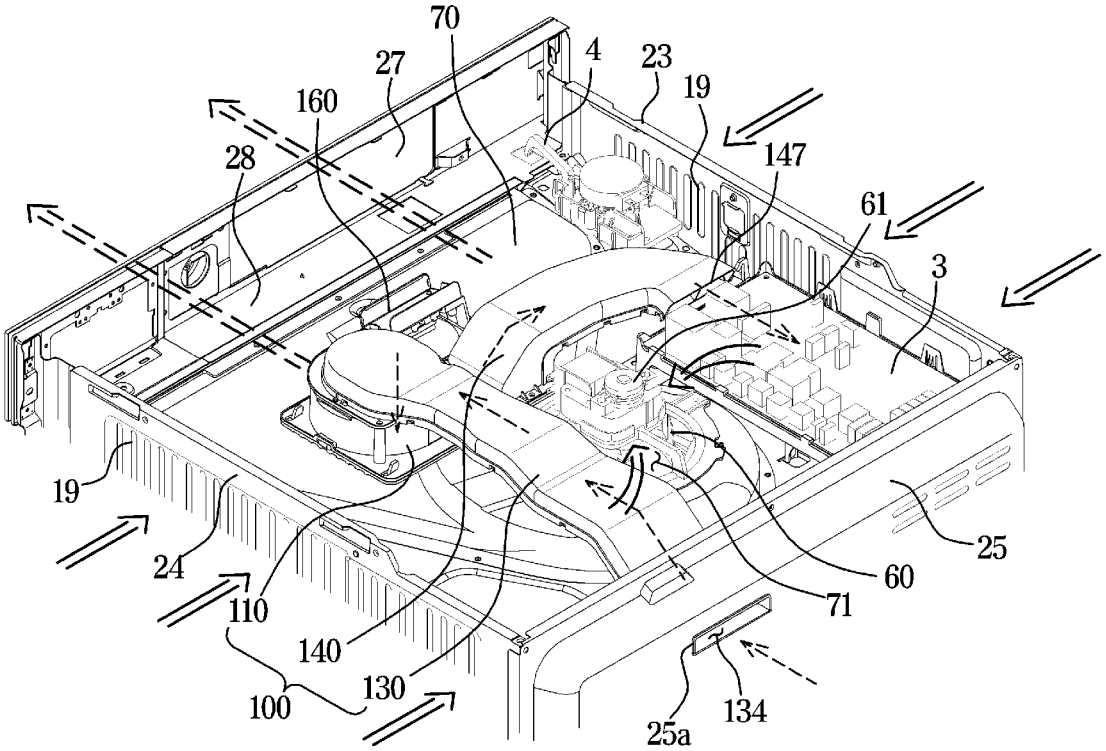
FIG. 17 is a view illustrating an airflow by the electronic compartment cooling fan and an airflow by the camera cooling fan of the cooking apparatus according to an embodiment of the disclosure.
Figure 18:
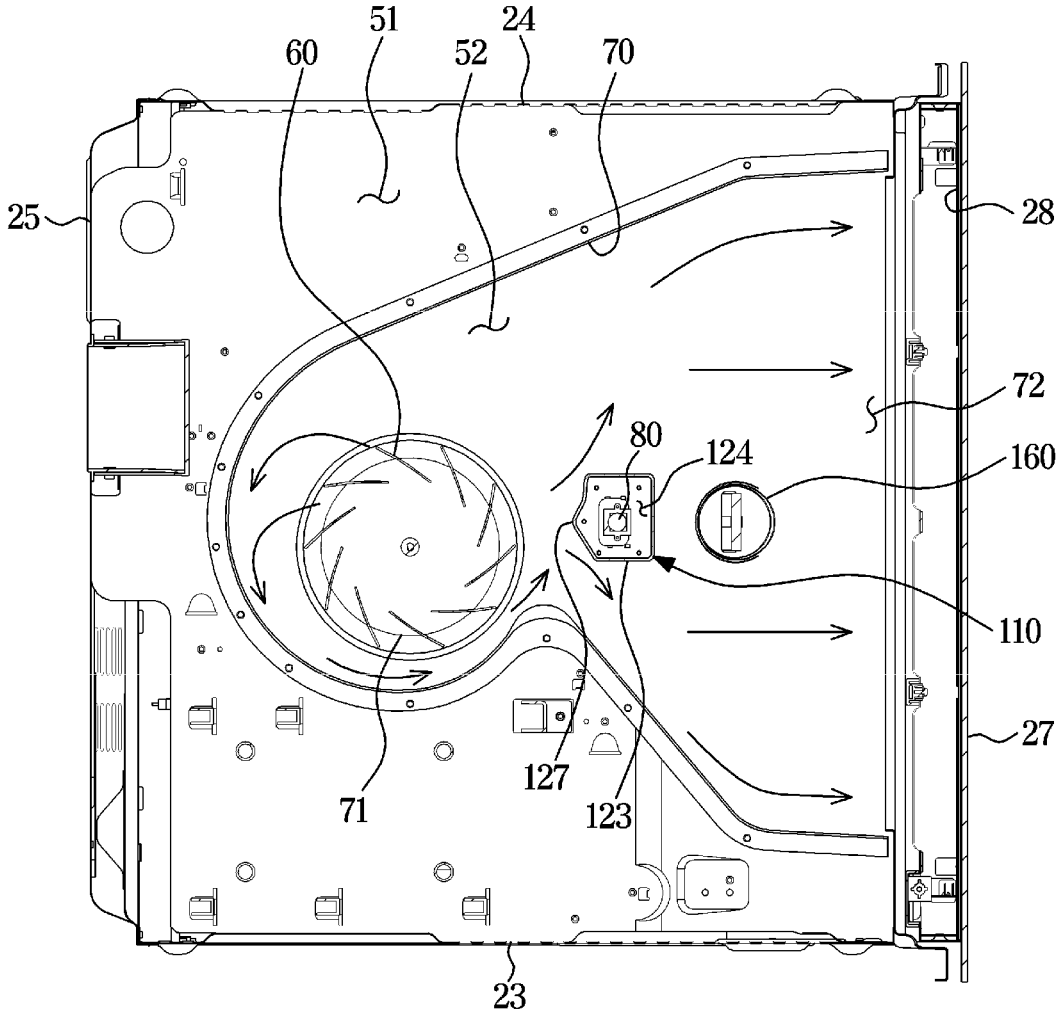
FIG. 18 is a view illustrating the airflow by the electronic compartment cooling fan of the cooking apparatus according to an embodiment of the disclosure.
Figure 19:
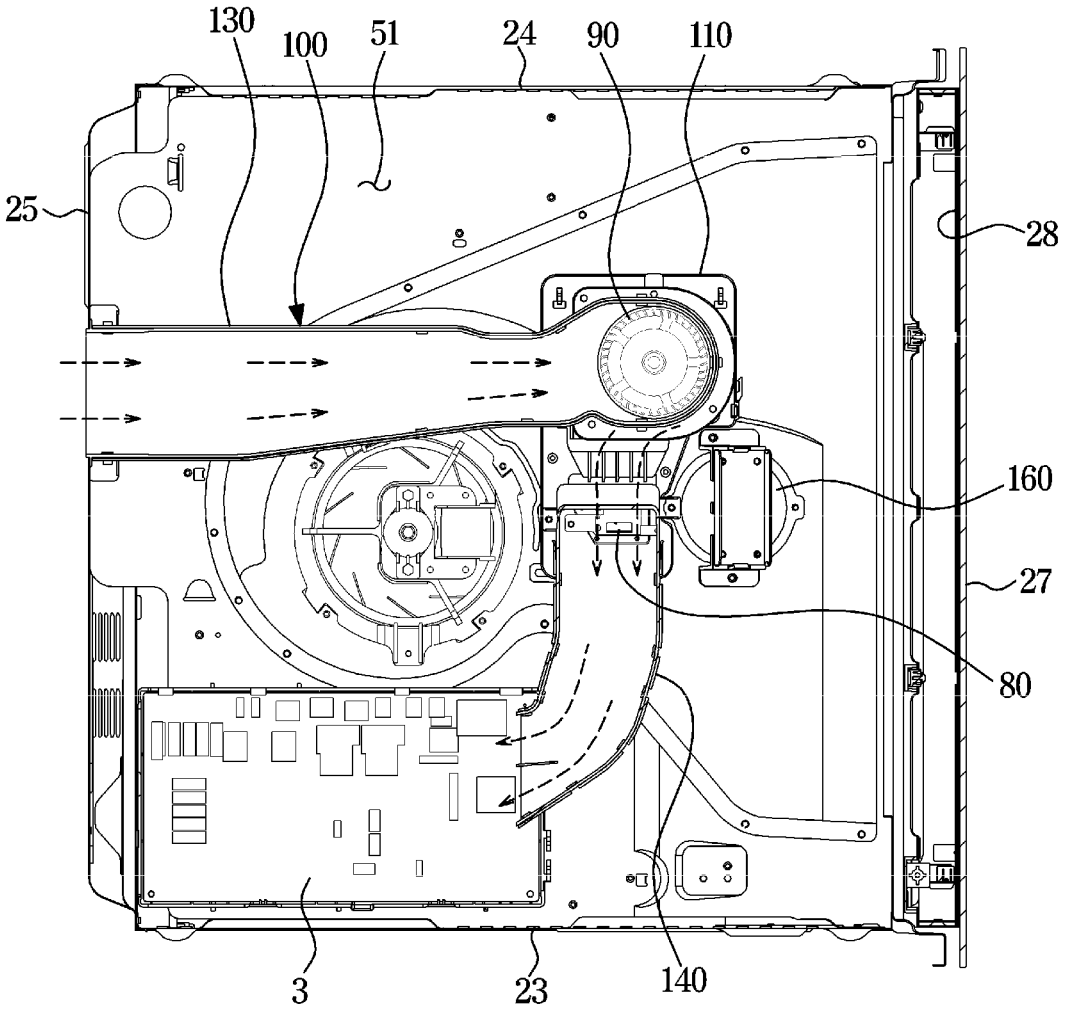
FIG. 19 is a view illustrating the airflow by the camera cooling fan of the cooking apparatus according to an embodiment of the disclosure.
Figure 20:
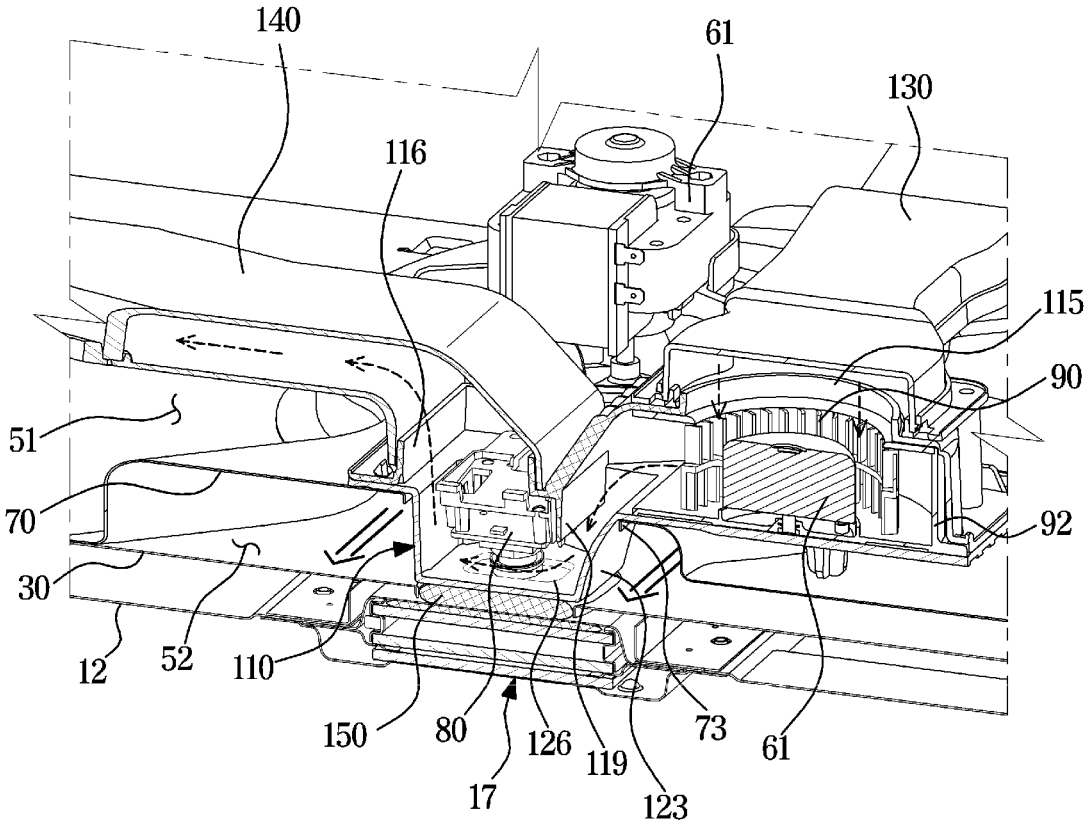
FIG. 20 is a view illustrating the airflow by the electronic compartment cooling fan and the airflow by the camera cooling fan of the cooking apparatus according to an embodiment of the disclosure.

FIG. 16 is a view illustrating a state in which the upper plate of the cooking apparatus according to an embodiment of the disclosure is removed. FIG. 17 is a view illustrating an airflow by the electronic compartment cooling fan and an airflow by the camera cooling fan of the cooking apparatus according to an embodiment of the disclosure. FIG. 18 is a view illustrating the airflow by the electronic compartment cooling fan of the cooking apparatus according to an embodiment of the disclosure. FIG. 19 is a view illustrating the airflow by the camera cooling fan of the cooking apparatus according to an embodiment of the disclosure. FIG. 20 is a view illustrating the airflow by the electronic compartment cooling fan and the airflow by the camera cooling fan of the cooking apparatus according to an embodiment of the disclosure.

As illustrated in FIGS. 16 to 20, the cooking apparatus 1 may include the electronic compartment cooling fan 60 configured to cool the entire electronic compartment 50 and the camera cooling fan 90 configured to intensively cool the camera 80.

When the electronic compartment cooling fan 60 is driven, the air in the electronic component space 51 may be sucked into the suction port 71 of the electronic compartment duct 70, pass through the exhaust space 52, and then be discharged to the outside of the main body 10 through the discharge port 72. That is, the electronic compartment cooling fan 60 may form a first air flow (refer to a double line arrow in FIG. 17, a double line arrow in FIG. 20 and refer to FIG. 18).

When the camera cooling fan 90 is driven, air outside the main body 10 may be sucked into the camera cooling duct 100, cool the camera 80 and be discharged to the electronic component space 51. That is, the camera cooling fan 90 may form a second air flow (refer to a single line arrow in FIG. 18, a single line arrow in FIG. 20 and refer to FIG. 19).

The housing 110 of the camera cooling duct 100 may include the camera receiving member 123 forming the camera receiving space 124 to receive the camera 80. The camera receiving member 123 may protrude to the lower side of the housing 110 and may be disposed inside the exhaust space 52. Accordingly, the first air flow flowing through the exhaust space 52 by the electronic compartment cooling fan 60 may pass through the camera receiving member 123. Accordingly, the first air flow may be in contact with an outer surface of the camera receiving member 123 to cool the camera receiving member 123. That is, the first air flow may indirectly cool the camera 80 disposed inside the camera receiving member 123 by cooling the camera receiving member 123.

The first air flow may pass through the camera receiving member 123 with respect to the front and rear direction of the main body 10. Conversely, the second air flow may pass through the camera 80 with respect to the left and right direction of the main body 10. Accordingly, the first air flow and the second air flow may directly or indirectly cool the camera 80 in directions perpendicular to each other. Accordingly, the camera 80 may be cooled by the double air flow and the cooling efficiency of the camera may be increased.

The housing 110 may include a branch guide 127 protruding from one surface of the camera receiving member 123 to minimize a resistance when the first air flow passes through the camera receiving member 123. The branch guide 127 may protrude in a triangular or streamlined shape. The first air flow toward the camera receiving member 123 may be diverged to the left and right of the camera receiving member 123 by the branch guide 127, and the first airflow may be smoothly performed.

As illustrated in FIG. 20, the structure of the suction duct 130, the housing 100, and the discharge duct 140 for the second air flow is provided in a U-shape to pass through the exhaust space 52, and thus it is possible to minimize an interruption which is generated by the camera cooling duct 100 and applied to the first air flow of the electronic compartment cooling fan 60.

Figure 21:
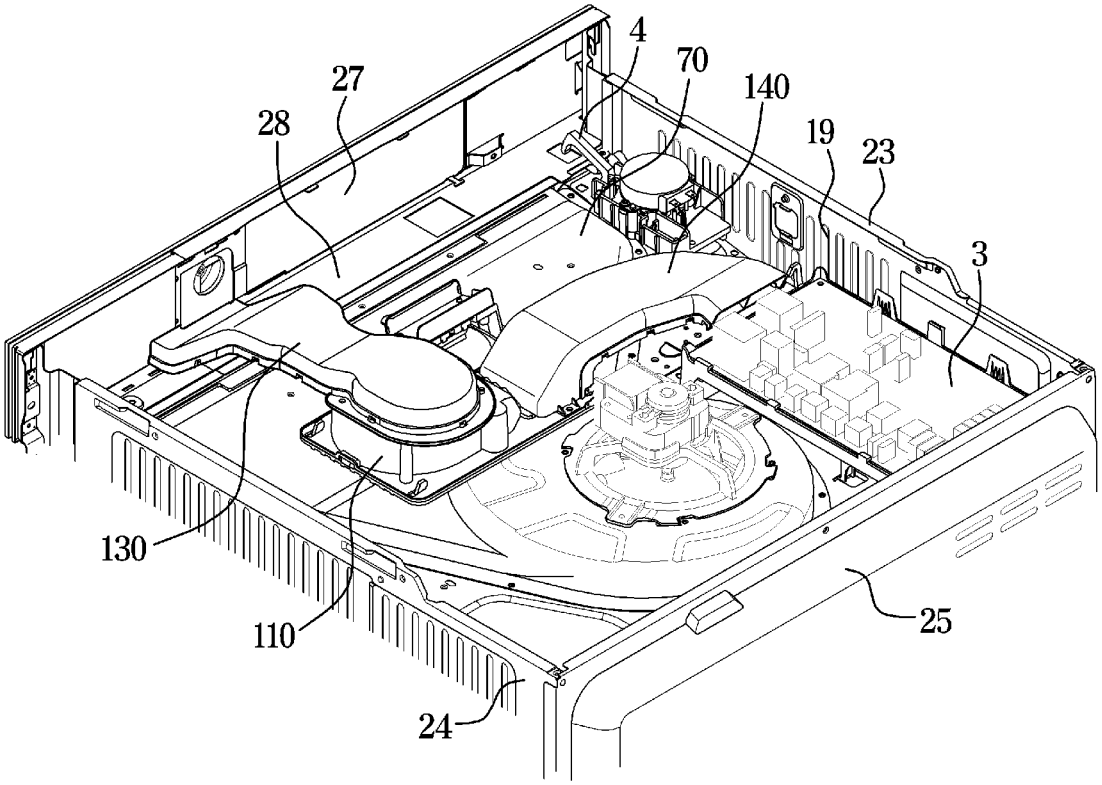
FIG. 21 is a view illustrating a state in which the upper plate of the cooking apparatus according to an embodiment of the disclosure is removed.
Figure 22:
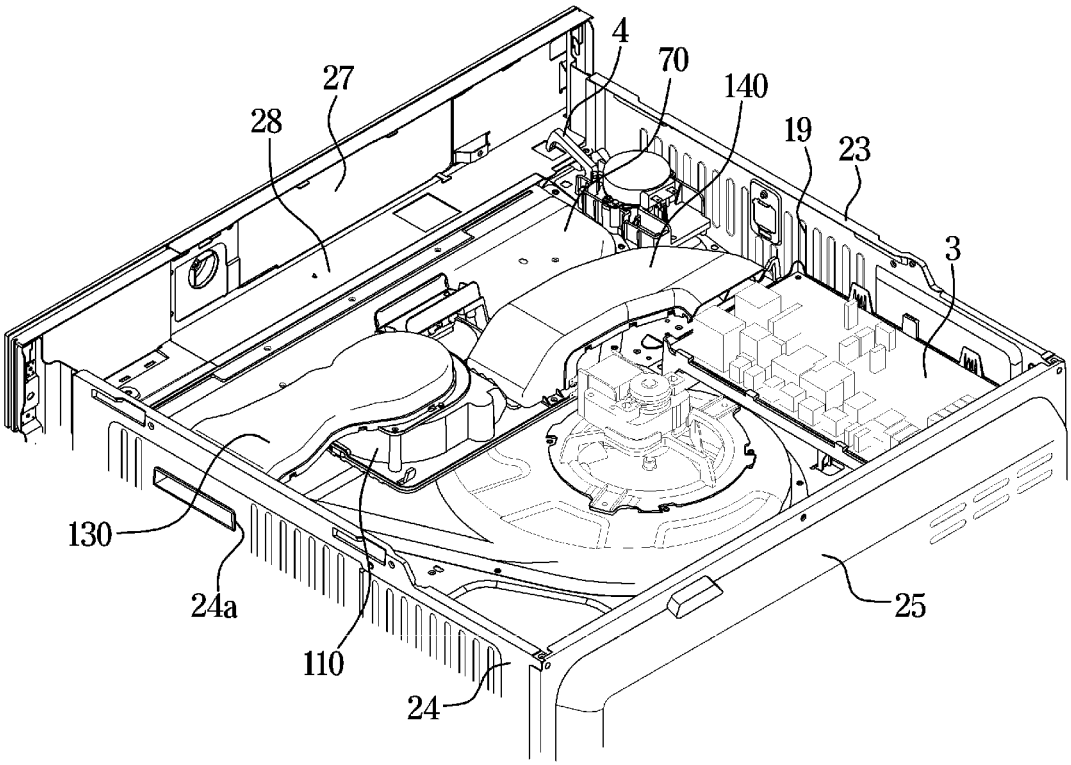
FIG. 22 is a view illustrating a state in which the upper plate of the cooking apparatus according to an embodiment of the disclosure is removed.

FIG. 21 is a view illustrating a state in which the upper plate of the cooking apparatus according to an embodiment of the disclosure is removed. FIG. 22 is a view illustrating a state in which the upper plate of the cooking apparatus according to an embodiment of the disclosure is removed.

As illustrated in FIGS. 21 and 22, according to an embodiment, the suction duct 130 provided to suck air from the outside of the main body 10 may suck air from the front or lateral side of the main body 10 instead of the rear side.

That is, as illustrated in FIG. 21, the suction duct 130 may be coupled to the control panel 27 or the panel bracket 28 to suck air from the front of the main body 10.

As illustrated in FIG. 22, the suction duct 130 may be coupled to the right plate 24 or the left plate 23 forming the side surface of the body 10 so as to suck air from the lateral side of the main body 10. When the suction duct 130 is coupled to the right plate 24, an outside air inlet 24*a* may be formed on the right plate 24, and when the suction duct 130 is coupled to the left plate 23, an outside air inlet may be formed on the left plate 23.

As mentioned above, the suction duct 130 may be formed to suck outside air from the rear, front, or lateral side of the main body 10, and the suction duct 130 may extend horizontally to the housing 110. Accordingly, it is possible to prevent foreign substances such as water or oil from being sucked in and transferred to the camera cooling fan 90 or the camera 80 through the outside air inlet 25*a* and 24*a*.

According to an embodiment, the cooking apparatus may include the main body 10 including the inner case 11, the cooking chamber 40 formed inside the inner case, and the electronic compartment 50 formed outside the inner case, the heating device 5 and 8 configured to heat the cooking chamber, the electronic compartment cooling fan 60 configured to cool the electronic compartment, the electronic compartment duct 70 arranged in the electronic compartment to divide the electronic compartment into the electronic component space 51 and the exhaust space 52, the electronic compartment duct provided to allow air of the electronic component space to be sucked into the exhaust space and to be discharged to an outside of the main body according to an operation of the electronic compartment cooling fan, the camera 80 configured to image an inside of the cooking chamber, the camera cooling fan 90 configured to cool the camera, and the camera cooling duct 100 including the camera receiving space 124 provided to receive the camera, the camera cooling duct provided to allow aft outside the main body 10 to be sucked into the camera receiving space 124 so as to cool the camera and to be discharged to the electronic component space 51 according to an operation of the camera cooling fan.

The camera cooling duct 100 may include the housing 110 including the camera receiving space 124, the suction duct 130 coupled to the housing so as to suck air outside the main body to the camera receiving space 124, and the discharge duct 140 coupled to the housing so as to discharge air of the camera receiving space 124 to the electronic component space 51.

The main body may include the rear plate 25 forming a rear surface of the main body, and the suction duct 140 may be coupled to the rear plate 25.

The cooking apparatus may further include the circuit board 3 disposed in the electronic compartment 50.

The discharge duct 140 may be provided to discharge air toward the circuit board 3.

The housing 110 may be coupled to the upper surface of the electronic compartment duct 70.

The housing 110 may include the inlet 115 to which an exit of the suction duct is connected, and the outlet 116 to which an entrance of the discharge duct is connected.

The inlet 115 and the outlet 116 may be formed on the upper surface of the housing 110.

The camera receiving space 124 may be located at a height corresponding to the exhaust space 52.

The housing 110 may include the upper opening 125 formed in an upper portion of the camera receiving space 124. Air may flow into the camera receiving space 124 through the upper opening 125 and air may flow out of the camera receiving space 124 through the upper opening 125.

The housing 110 may include the cooling fan receiving space 114 provided to receive the camera cooling fan 90.

The camera receiving space 124 may be located downstream of the cooling fan receiving space 114 with respect to an air flow direction.

The camera receiving space 124 may be located below the cooling fan receiving space 114.

The housing 110 may include the camera receiving member 123 protruding downward to form the camera receiving space 124.

The housing 110 may include the cooling fan receiving member 113 protruding upward to form the cooling fan receiving space 114.

The housing 110 may include the upper housing 111 including the inlet 115 and the outlet 116 and the lower housing 121 coupled to the upper housing.

According to an embodiment, the cooking apparatus may include the main body including the cooking chamber and the electronic compartment, the heating device 5 and 8 configured to heat the cooking chamber, the camera 80 configured to image an inside of the cooking chamber, the housing 110 including the camera receiving space 124 provided to receive the camera, the camera cooling fan 90 configured to cool the camera, and the suction duct 130 provided to allow air outside the main body to be sucked into the camera receiving space so as to cool the camera according to an operation of the camera cooling fan. One end of the suction duct may be coupled to the housing and the other end of the suction duct may be connected to the rear plate 25 forming a rear surface of the main body 10.

The outside air inlet 25*a* may be formed on the rear plate to allow air outside the main body to be sucked thereinto.

The suction duct may include the suction duct body 131 extending from the rear plate to the housing, and the suction flow path 132 formed inside the suction duct body.

The cooking apparatus may further include the electronic compartment cooling fan 60 arranged in the electronic compartment, and the electronic compartment duct 70 provided to allow air of the electronic compartment to be sucked and to be discharged to an outside of the main body according to an operation of the electronic compartment cooling fan.

According to an embodiment, the cooking apparatus may include the main body including the cooking chamber and the electronic compartment, the heating device 5 and 8 configured to heat the cooking chamber, the electronic compartment cooling fan 60 configured to cool the electronic compartment, the electronic compartment duct 70 arranged in the electronic compartment to divide the electronic compartment 50 into the electronic component space 51 and the exhaust space 52, the electronic compartment duct provided to allow air of the electronic component space 51 to be sucked into the exhaust space 52 and to be discharged to an outside of the main body according to an operation of the electronic compartment cooling fan, the camera 80 configured to image an inside of the cooking chamber, the camera cooling fan 90 configured to cool the camera, the housing 110 including the camera receiving space 124 provided to receive the camera, and the suction duct 130 provided to allow air outside the main body 10 to be sucked into the camera receiving space so as to cool the camera according to an operation of the camera cooling fan. The housing 110 may include the outlet 116 provided to allow air of the camera receiving space to be discharged to the electronic component space.

As is apparent from the above description, a cooking apparatus may include a camera cooling structure configured to prevent a temperature rise of a camera caused by heat generated in a cooking chamber.

Further, it is possible to prevent foreign substances such as water and oil from entering through a suction duct used to cool a camera.

Further, a bottom of a camera may be efficiently cooled.

Further, a camera cooling structure for intensively cooling a camera may be separated from a cooling structure for cooling an entire electronic compartment, and thus an efficiency of the cooling structure for the electronic compartment may not decrease.

Further, an electronic component such as a circuit board as well as a camera may be efficiently cooled.

Further, a camera of a cooking apparatus may image an entire shelf regardless of an installation height of the shelf.

Further, a camera cooling structure may provide a uniform and strong air flow to a bottom of the camera, and thus it is possible to prevent a foreign substance from being attached to the camera or it is possible to remove a foreign substance attached to the camera.

The effects of the present disclosure are not limited to those mentioned above, and other effects not mentioned will be apparent from the following description to one of ordinary skill in the art to which the present disclosure belongs.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A cooking apparatus comprising:

a main body including an inner case, a cooking chamber inside the inner case, and an electronic compartment outside the inner case;

a heating device configured to heat the cooking chamber;

an electronic compartment cooling fan configured to cool the electronic compartment;

an electronic compartment duct in the electronic compartment and dividing the electronic compartment into an electronic component space and an exhaust space, the electronic compartment duct configured to allow air in the electronic component space to be sucked into the exhaust space and to then be discharged to an outside of the main body according to an operation of the electronic compartment cooling fan;

a camera cooling duct including:

a housing that includes a camera receiving space and a cooling fan receiving space, a suction duct coupled to the housing and longitudinally extending from the housing to an air inlet, and a discharge duct coupled to the housing and longitudinally extending from the housing to an exit of the discharge duct;

a camera in the camera receiving space and configured to obtain an image of an inside of the cooking chamber; and a camera cooling fan in the cooling fan receiving space, wherein, according to an operation of the camera cooling fan, the suction duct is configured to allow air that is outside of the main body to be sucked through the air inlet into the camera receiving space so as to cool the camera and the discharge duct is configured to discharge the air in the camera receiving space through the exit to the electronic component space.

2. The cooking apparatus of claim 1, wherein the main body includes a rear plate forming a rear surface of the main body, the rear plate having the air inlet formed through the rear plate, and the suction duct is coupled to the rear plate.

3. The cooking apparatus of claim 1, further comprising:

a circuit board in the electronic component space, wherein the discharge duct is configured to discharge air toward the circuit board.

4. The cooking apparatus of claim 1, wherein the housing is coupled to an upper surface of the electronic compartment duct.

5. The cooking apparatus of claim 1, wherein the housing includes an inlet to which an exit of the suction duct is connected, and an outlet to which an entrance of the discharge duct is connected.

6. The cooking apparatus of claim 5, wherein the inlet and the outlet are on an upper surface of the housing.

7. The cooking apparatus of claim 1, wherein the camera receiving space is located at a height corresponding to the exhaust space.

8. The cooking apparatus of claim 1, wherein the housing includes an upper opening formed in an upper portion of the camera receiving space, and the upper opening is configured so that air flows into the camera receiving space through the upper opening and air flows out of the camera receiving space through the upper opening.

9. The cooking apparatus of claim 1, wherein the camera receiving space is located downstream of the cooling fan receiving space with respect to an air flow direction.

10. The cooking apparatus of claim 1, wherein the camera receiving space is located below the cooling fan receiving space.

11. The cooking apparatus of claim 1, wherein the housing incudes a camera receiving member protruding downward to form the camera receiving space.

12. The cooking apparatus of claim 1, wherein the housing includes a cooling fan receiving member protruding upward to form the cooling fan receiving space.

13. The cooking apparatus of claim 5, wherein:

the housing includes an upper housing that includes the inlet and the outlet, and a lower housing coupled to the upper housing.

14. A cooking apparatus comprising:

a main body including a rear plate forming a rear surface of the main body, the rear plate having an air inlet formed through the rear plate, and the main body having a cooking chamber inside the main body;

a heating device configured to heat the cooking chamber;

a housing, inside the main body, having a camera receiving space and a cooling fan receiving space;

a camera in the camera receiving space, and configured to obtain an image of an inside of the cooking chamber;

a camera cooling fan in the cooling fan receiving space, and configured to cool the camera; and a suction duct having one end coupled to the housing and an other end coupled to the rear plate, and being configured to allow air that is outside of the main body to be sucked through the air inlet into the camera receiving space so as to cool the camera according to an operation of the camera cooling fan.

15. The cooking apparatus of claim 14, wherein the suction duct includes a suction duct body extending from the rear plate to the housing, and a suction flow path is formed inside the suction duct body.

16. The cooking apparatus of claim 14, wherein the main body has an electronic compartment inside the main body, and the cooking apparatus further comprising:

an electronic compartment cooling fan in the electronic compartment; and an electronic compartment duct configured to allow air in the electronic compartment to be sucked and to then be discharged to an outside of the main body according to an operation of the electronic compartment cooling fan.

17. A cooking apparatus comprising:

a main body having a cooking chamber and an electronic compartment inside the main body;

a heating device configured to heat the cooking chamber;

an electronic compartment cooling fan configured to cool the electronic compartment;

an electronic compartment duct in the electronic compartment and dividing the electronic compartment into an electronic component space and an exhaust space, the electronic compartment duct configured to allow air in the electronic component space to be sucked into the exhaust space and to then be discharged to an outside of the main body according to an operation of the electronic compartment cooling fan;

a housing having a camera receiving space, a cooling fan receiving space, and an outlet through which air in the camera receiving space is dischargeable to the electronic component space;

a camera in the camera receiving space and configured to obtain an image of an inside of the cooking chamber;

a camera cooling fan in the cooling fan receiving space and configured to cool the camera; and a suction duct longitudinally extending from the housing to an air inlet, and configured to allow air that is outside the main body to be sucked through the air inlet into the camera receiving space so as to cool the camera according to an operation of the camera cooling fan.

* * * * *